US007416838B2

(12) United States Patent
Fujiwara

(10) Patent No.: US 7,416,838 B2
(45) Date of Patent: Aug. 26, 2008

(54) PHOTOTHERMOGRAPHIC MATERIAL

(75) Inventor: Itsuo Fujiwara, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/708,359

(22) Filed: Feb. 21, 2007

(65) Prior Publication Data

US 2007/0207417 A1 Sep. 6, 2007

(30) Foreign Application Priority Data

Mar. 1, 2006 (JP) ..... 2006-055527

(51) Int. Cl.
*G03C 1/498* (2006.01)
*G03C 1/76* (2006.01)

(52) U.S. Cl. ..... 430/537; 430/517; 430/523; 430/531; 430/534; 430/619; 430/631; 430/640; 430/642

(58) Field of Classification Search ..... 430/619, 430/534, 531, 523, 517, 537, 631, 640, 642
See application file for complete search history.

(56) References Cited

U.S. PATENT DOCUMENTS 6,190,854 B1 * 2/2001 Sampei ..... 430/617
6,599,686 B2 * 7/2003 Geisler et al. ..... 430/350
2004/0063049 A1 * 4/2004 Nakajima et al. ..... 430/534
2004/0115572 A1 * 6/2004 Tsukada et al. ..... 430/619
2005/0214700 A1 * 9/2005 Yamamoto et al. ..... 430/619

FOREIGN PATENT DOCUMENTS

JP A 2003-262934 9/2003

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material having, on one side of a support, an image forming layer including at least a photosensitive silver halide, a non-photosensitive organic silver salt, a reducing agent, and a binder, and at least one non-photosensitive layer which is disposed on the same side of the support as the image forming layer and farther from the support than the image forming layer, wherein the non-photosensitive layer includes at least a copolymer latex of an acrylate or methacrylate having a fluorine atom and a monomer component having a hydrophobic group, and the surface of the side having the image forming layer includes convex portions having a height of 1.5 μm or higher in an amount of from 20 to 2000 per 1 $mm^2$. A photothermographic material which exhibits excellent film physical properties and high image quality is provided.

17 Claims, No Drawings

PHOTOTHERMOGRAPHIC MATERIAL

CROSS-REFERENCE TO RELATED APPLICATION

This application claims priority under 35 USC 119 from Japanese Patent Application No. 2006-055527, the disclosure of which is incorporated by reference herein.

BACKGROUND OF THE INVENTION

1. Field of the Invention

The present invention relates to a photothermographic material. More specifically, the invention relates to a photothermographic material which exhibits improved film surface strength.

2. Description of the Related Art

In recent years, in the field of films for medical imaging, there has been a strong desire for decreasing the amount of processing liquid waste from the viewpoints of protecting the environment and economy of space. Technology is therefore required for light-sensitive photothermographic materials which can be exposed effectively by laser image setters or laser imagers and thermally developed to obtain clear black-toned images of high resolution and sharpness, for use in medical diagnostic applications and for use in photographic technical applications. The light-sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are described in many documents. In particular, photothermographic materials generally have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Further, the Fuji Medical Dry Imager FM-DPL is an example of a medical image forming system using photothermographic materials that has been made commercially available.

Thermal developing processing does not require the processing solutions used in wet developing processing, and has an advantage in that processing can be carried out easily and rapidly. However, on the other hand, there are particular problems to be solved because the photothermographic materials contain all components necessary for image formation in coated layers in advance and contain unreacted components or reaction products after image formation in the film. One is a problem concerning storage stability of the photothermographic material such as storage stability prior to use for image forming processing after production and storage stability of an image after image formation. Another is a problem concerning physical strength of the coated film such as being brittle or susceptible to defects.

As a means for improving image storage stability, for example, Japanese Patent Application Laid-Open (JP-A) No. 11-352624 discloses the use of a non-photosensitive silver salt in a non-photosensitive layer on a side having an image forming layer. All patents, patent publications, and non-patent literature cited in this specification are hereby expressly incorporated by reference herein. However, there are problems concerning further deterioration of film physical properties caused by an increase in total layer thickness accompanying the increase in an amount of binder for including the non-photosensitive silver salt in the non-photosensitive layer or an additional layer.

As a means for improving film physical properties, for example, JP-A Nos. 9-146220, 11-228698, and 2003-262934 disclose the use of a non-bleaching dye technique instead of using a bleaching dye method as an antihalation dye technique. Various components such as base generating agents or radical generating agents used for the bleaching dye method are unnecessary and therefore result in decreasing the burden on the film, which is favorable for the film physical properties. However, there are problems such as occurrence of color unevenness due to color transfer of water-soluble dyes when they are contacted therewith.

Moreover, in order to provide resistance to defects on the film surface and prevent adhesion or color transfer during stacking, it is well known in the art to provide surface roughness by adding a matting agent in a surface layer of silver halide photographic materials.

SUMMARY OF THE INVENTION

The present invention has been made in view of the above circumstances and provides a photothermographic material comprising, on one side of a support, an image forming layer comprising at least a photosensitive silver halide, a non-photosensitive organic silver salt, a reducing agent, and a binder, and at least one non-photosensitive layer which is disposed on the same side of the support as the image forming layer and farther from the support than the image forming layer, wherein the non-photosensitive layer comprises at least a copolymer latex of an acrylate or methacrylate having a fluorine atom and a monomer component having a hydrophobic group, and the surface of the side having the image forming layer comprises convex portions having a height of 1.5 μm or higher in an amount of from 20 to 2000 per 1 $mm^2$.

DETAILED DESCRIPTION OF THE INVENTION

An object of the present invention is to provide a photothermographic material which exhibits excellent film physical properties and high image quality. In particular, an object of the present invention is to provide a photothermographic material, which is improved in strength with respect to abrasion and is improved with respect to preventing generation of abrasion streaks during laser exposure.

The inventors have investigated providing roughness on a film surface by adding a matting agent in a surface layer in order to prevent abrasion on the film surface or to prevent adhesion or color transfer during stacking. However, in a photothermographic material in which imagewise exposure is performed by scanning exposure with a laser beam, whereas the addition of a matting agent provides improvement with respect to adhesion trouble, it was found that image density on the rubbed portion is unexpectedly lowered to form a white streak when the material is subjected to laser exposure and thermal development after rubbing the surface. This white streak is observed only after laser exposure and thermal development and therefore is considered to be a problem unique to the system, which needs to be solved.

The present inventors have intensively researched means for solving the problems described above. As a result, the inventors found a method for solving the problems by controlling the surface roughness to within a specific range using a specific polymer latex containing a fluorine atom, and thereby arrived at the present invention.

According to the present invention, a photothermographic material which exhibits excellent film physical properties and high image quality is provided. In particular, a photothermographic material, which is improved with respect to preventing generation of white streaks due to abrasion, is provided.

The photothermographic material of the present invention has, on one side of a support, an image forming layer including at least a photosensitive silver halide, a non-photosensitive organic silver salt, a reducing agent, and a binder, and at least one non-photosensitive layer which is disposed on the same side of the support as the image forming layer and farther from the support than the image forming layer, wherein the non-photosensitive layer includes at least a copolymer latex of an acrylate or methacrylate having a fluorine atom and a monomer component having a hydrophobic group, and the surface of the side having the image forming layer has convex portions having a height of 1.5 μm or higher in an amount of from 20 to 2000 per 1 $mm^2$.

Preferably, the acrylate or methacrylate having a fluorine atom is represented by the following formula (1).

Formula (1)

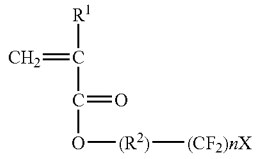

In formula (1), $R^1$ represents a hydrogen atom, a fluorine atom, or a methyl group. $R^2$ represents a methylene group, an ethylene group, or a 2-hydroxypropylene group. X represents a hydrogen atom or a fluorine atom, and n represents an integer of from 1 to 4.

Preferably, the monomer component having a hydrophobic group is represented by the following formula (2).

Formula (2)

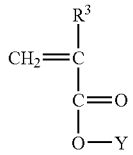

In formula (2), $R^3$ represents a hydrogen atom or a methyl group, and Y represents an alkyl group, an alicyclic group, or an aromatic ring group.

The surface of the side having the image forming layer has convex portions having a height of 1.5 μm or higher in an amount of from 20 to 2000 per 1 $mm^2$, and preferably in an amount of from 100 to 1000 per 1 $mm^2$.

It is more preferred that there are few convex portions having a height of 6.0 μm or higher. The surface of the side having the image forming layer preferably has convex portions having a height of 6.0 μm or higher in an amount of 10 or fewer per 1 $mm^2$, and more preferably in an amount of one or fewer per 1 $mm^2$.

Conventionally, in order to protect the surface and prevent adhesion trouble during stacking, a plurality of concave or convex portions is formed on the surface by adding a matting agent in a surface layer of a photothermographic material. Usually, the convex portions are formed thereby in an amount of more than 2,000 per 1 $mm^2$.

The present inventors have analyzed the cause of white streaks occurring during thermal development after laser exposure, and as a result, the present inventors presumed that, although the details are unclear, deformation and density change of the matting agent may occur on a portion where abrasion occurs on the surface, whereby a laser beam may suffer from some abnormal optical effects such as scattering, interference, or the like. The present inventors have intensively researched means for improvement based on the above analytical results and found that adjustment of the number of surface convex portions by a matting agent to within the range according to the present invention and addition of a polymer latex including an acrylate monomer or methacrylate monomer having a fluorine atom as a copolymerization component in the surface protective layer are effective for preventing the occurrence of white streaks, providing a sufficient surface protection ability, and providing improvement with respect to adhesion trouble.

In a case where convex portions having a height of 1.5 μm or higher exist in an amount of 20 or less per 1 $mm^2$, surface protection ability is not sufficient, and it is not favorable because adhesion trouble occurs. In a case where convex portions having a height of 1.5 μm or higher exist in an amount of more than 2,000 per 1 $mm^2$, it is not favorable because white streak trouble increases.

Further, in a case where convex portions having a height of 6.0 μm or higher exist in an amount of more than 10 per 1 $mm^2$, it is not favorable because white streak trouble increases.

Preferably, the non-photosensitive layer contains a matting agent having a mean particle size of from 2.0 μm to 8.0 μm.

Preferably, a content of the matting agent is from 0.0001 $g/m^2$ to 0.08 $g/m^2$.

Preferably, an $F_{1S}/C_{1S}$ ratio of the surface on the side having the image forming layer is 2.0 or more.

Preferably, the photothermographic material of the present invention further has, on the same side of the support as the image forming layer and farther from the support than the image forming layer, a non-photosensitive layer containing an organic silver salt, which is different from the non-photosensitive organic silver salt contained in the image forming layer. More preferably, the photothermographic material of the present invention has the non-photosensitive layer containing an organic silver salt between the image forming layer and the non-photosensitive layer containing the copolymer latex of an acrylate or methacrylate having a fluorine atom and a monomer component having a hydrophobic group.

Preferably, the image forming layer further includes a polymer latex having a monomer component represented by the following formula (M).

$$CH_2{=}CR^{01}{-}CR^{02}{=}CH_2 \qquad \text{Formula (M)}$$

In formula (M), $R^{01}$ and $R^{02}$ each independently represent one selected from a hydrogen atom, an alkyl group having 1 to 6 carbon atoms, a halogen atom, or a cyano group. Preferably, both of $R^{01}$ and $R^{02}$ are a hydrogen atom, or one of $R^{01}$ or $R^{02}$ is a hydrogen atom and the other is a methyl group.

Preferably, the photothermographic material of the present invention contains a dye represented by the following formula (PC-1).

Formula (PC-1)

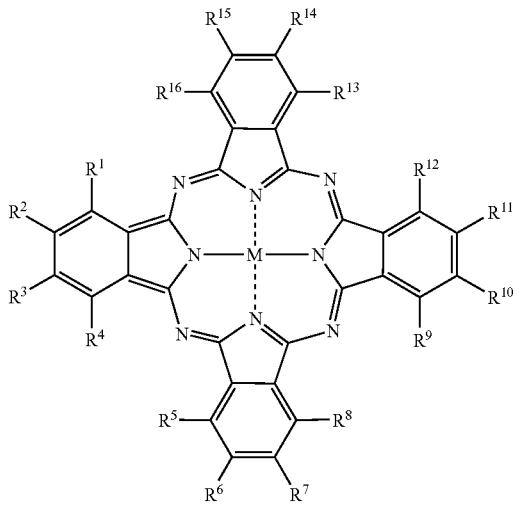

In formula (PC-1), M represents a metal atom. $R^1$, $R^4$, $R^5$, $R^8$, $R^9$, $R^{12}$, $R^{13}$, and $R^{16}$ each independently represent a hydrogen atom or a substituent, and at least one of $R^1$, $R^4$, $R^5$, $R^8$, $R^9$, $R^{12}$, $R^{13}$, and $R^{16}$ is an electron-attracting group. $R^2$, $R^3$, $R^6$, $R^7$, $R^{10}$, $R^{11}$, $R^{14}$, and $R^{15}$ each independently represent a hydrogen atom or a substituent.

More preferably, in formula (PC-1) described above, at least one of $R^1$, $R^4$, $R^5$, $R^8$, $R^9$, $R^{12}$, $R^{13}$, and $R^{16}$ is a group represented by formula (II).

$$-L^1-R^{17}$$ Formula (II)

In formula (II), $L^1$ represents one selected from **—$SO_2$—*, **—$SO_3$—*, **—$SO_2NR_N$—*, **—SO—*, **CO—*, **—$CONR_N$—*, **—COO—*, **—COCO—*, **—$COCO_2$—*, or **—$COCONR_N$—*. ** denotes a bond with a phthalocyanine skeleton at this position, and * denotes a bond with $R^{17}$ at this position. $R_N$ represents one selected from a hydrogen atom, an alkyl group, an aryl group, a heterocyclic group, an acyl group, an alkoxycarbonyl group, a carbamoyl group, a sulfonyl group, or a sulfamoyl group. $R^{17}$ represents one selected from a hydrogen atom, an alkyl group, an aryl group, or a heterocyclic group.

Even more preferably, in formula (PC-1) described above, four or more from among $R^1$, $R^4$, $R^5$, $R^8$, $R^9$, $R^{12}$, $R^{13}$, and $R^{16}$ are each independently a group represented by formula (II).

Further preferably, the dye represented by formula (PC-1) described above is a water-soluble dye.

The present invention is explained below in detail.

(Constitution of Non-Photosensitive Layers Disposed on the Side having the Image Forming Layer)

In the present invention, the side of the support having the image forming layer is referred to as the image forming layer side, and the other side thereof is referred to as the backside.

The photothermographic material of the present invention has, on the image forming layer side, at least one non-photosensitive layer including a polymer latex, which contains an acrylate or methacrylate monomer having a fluorine atom as a copolymerization component, and a matting agent. Preferably, the non-photosensitive layer is an outermost layer on the image forming layer side.

Preferably, the photothermographic material of the present invention has a second non-photosensitive layer between the outermost layer and the image forming layer, wherein the second non-photosensitive layer contains a second non-photosensitive organic silver salt, which is different from the non-photosensitive organic silver salt contained in the image forming layer.

Preferably, at least one of the outermost layer, the second non-photosensitive layer, or the image forming layer contains the dye represented by formula (PC-1).

1) Outermost Layer

The outermost layer in the present invention means an outermost non-photosensitive layer disposed on the image forming layer side. The outermost layer may be a single layer, or plural layers.

<Binder>

Any compounds having a film-forming property may be used as the binder of the outermost layer of the present invention, but gelatin is preferred. Other binders such as poly(vinyl alcohol) (PVA) or the like may be used in combination with gelatin. Preferred examples of PVA include those described in JP-A No. 2000-171936 (paragraph Nos. 0009 to 0020), and completely saponified poly(vinyl alcohol) PVA-105, partial saponified poly(vinyl alcohol) PVA-205 and PVA-335, and modified poly(vinyl alcohol) MP-203 (trade names, all available from Kuraray Co., Ltd.) are preferable.

The coating amount of the total binder in the outermost layer is preferably in a range of from 0.3 g/$m^2$ to 5.0 g/$m^2$, and more preferably from 0.3 g/$m^2$ to 2.0 g/$m^2$.

<Polymer Latex Comprising Acrylate or Methacrylate Monomer having a Fluorine Atom as a Copolymerization Component>

The polymer used in the present invention can be obtained by polymerizing at least one monomer unit of fluorine-containing acrylate and/or fluorine-containing methacrylate. The monomer can be represented by the following formula:

$$CH_2{=}C(R)COOL(Rf)X$$

wherein R represents a methyl group, a hydrogen atom, or a fluorine atom; L represents a simple bond, or a straight or branched alkyl group or a hydrocarbyl group in which a substituted or unsubstituted heteroatom such as O, S, N, or P may be intervened therebetween; Rf represents a straight, branched or cyclic chain of a completely fluorinated carbon atom; and X represents a hydrogen atom or a fluorine atom.

Among them, a monomer represented by formula (1) is preferred:

Formula (1)

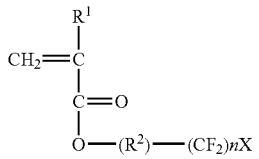

wherein $R^1$ represents a hydrogen atom, a fluorine atom, or a methyl group; $R^2$ represents a methylene group, an ethylene group, or a 2-hydroxypropylene group; X represents a hydrogen atom or a fluorine atom; and n represents an integer of from 1 to 4.

The hydrophobic group contained in the monomer component containing a hydrophobic group used in the present invention means a group having no hydratable ionic group or hydratable nonionic group such as a monofunctional or multifunctional carboxy group, a sulfonic acid group, a substituted or unsubstituted amino group, a hydroxy group, an oxyalkylene group, or a polyoxyalkylene group.

The copolymer according to the present invention is preferably added so as to provide an $F_{1S}/C_{1S}$ ratio of 2.0 or more for the surface on the image forming layer side.

The term "$F_{1S}/C_{1S}$ ratio" used herein means a ratio of the number of fluorine atoms to the number of carbon atoms present on the surface of the photothermographic material.

Concerning the measuring method of the F/C value, the photothermographic material is cut into a size of 0.5 cm×0.5 cm and then subjected to an elemental analysis with regard to fluorine atoms and carbon atoms, using an ESCA 750 (trade name, produced by Shimadzu Corp.). The ratio can be calculated from the peak height by $F_{1S}$ for fluorine atoms and the peak height by $C_{1S}$ derived from CH for carbon atoms.

The most important point in the structure of the constituent unit represented by formula (1) is that n is from 1 to 4 in the formula.

From the standpoint of water repelling property or the like, it is generally considered that the number of carbon atoms (n in formula (1)) in the perfluoro group of perfluoroacrylate or perfluoromethacrylate is preferably 8 or more at which water repelling property comes to saturation. However, the present inventors have intensively investigated and found that a polymer satisfying all desired properties can be obtained when n is within the range of from 1 to 4.

The desired properties include a property of having an electrification order control function, a property of having blocking resistance upon heating or pressure, good compatibility with a polymer binder constituting the layer in which the polymer is present, and good solubility in the solvent used.

The constituent unit represented by formula (1) can be obtained by copolymerizing the corresponding monomer such as fluoroalkyl acrylate, fluoroalkyl methacrylate, or fluoroalkyl α-fluoroacrylate.

Particularly, fluoroalkyl acrylate and fluoroalkyl methacrylate are preferable. The following products are commercially available from Daikin Industries, Ltd. with the following trade names.

For example,

M-1110 (2,2,2-trifluoroethyl methacrylate),
M-1210 (2,2,3,3,3-pentafluoropropyl methacrylate),
M-1420 (2-(perfluorobutyl)ethyl methacrylate),
M-1433 (3-(pentafluorobutyl)-2-hydroxy propyl),
M-5210 (1H,1H,3H-tetrafluoropropyl methacrylate),
M-5410 (1H,1H,5H-octafluoropropyl methacrylate),
M-7210 (1H-1-(trifluoromethyl)trifluoroethyl methacrylate),
M-7310 (1H,1H,3H-hexylfluorobutyl methacrylate),
A-1110 (2,2,2-trifluoroethyl acrylate),
A-1210 (2,2,3,3,3-pentafluoropropyl acrylate),
A-1420 (2-(perfluorobutyl)ethyl acrylate),
A-1433 (3-(pentafluorobutyl)-2-hydroxypropyl,
A-5210 (1H,1H,3H-tetrafluoropropyl acrylate),
A-5410 (1H,1H,5H-octafluoropropyl acrylate),
A-7210 (1H-1-(trifluoromethyl)trifluoroethyl acrylate), and
A-7310 (1H, 1H, 3H-hexafluorobutyl acrylate) are available.

Next, the constituent unit capable of copolymerizing with the compound represented by formula (1) is explained below. This constituent unit can be expressed, for example, by the following formula (2).

Formula (2)

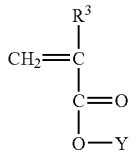

In formula (2), $R^3$ represents a hydrogen atom or a methyl group, and Y represents an alkyl group, an alicyclic group, or an aromatic ring group.

In the above formula (2), it is most important in the practice of the present invention that the compound represented by formula (2) includes no hydratable group.

Specifically, examples include, but are not limited to, alkyl acrylate (for example, methyl acrylate, ethyl acylate, butyl acrylate, propyl acrylate, n-hexyl acrylate, 2-ethylhexyl acrylate, iso-nonyl acrylate, n-dodecyl acrylate, stearyl acrylate, or the like), benzyl acrylate, cyclohexyl acrylate, alkyl methacrylate (for example, methyl methacrylate, ethyl methacrylate, propyl methacrylate, butyl methacrylate, hexyl methacrylate, 2-ethylhexyl methacrylate, iso-nonyl methacrylate, dodecyl methacrylate, octadecyl methacrylate, stearyl methacrylate, or the like), benzyl methacrylate, and cyclohexyl methacrylate.

Further, specific commercially available products such as NDN-2000 (trade name, available form Nicca Chemical Co., Ltd.), AG-7000 (trade name, available from Asahi Glass Co., Ltd.) and FS-6010 (trade name, available from Fluorotech Co., Ltd.) can be employed.

Next, concerning constituent units having an epoxy unit capable of copolymerizing with these constituent units described above, these can be introduced by copolymerizing glycidyl methacrylate, glycidyl acrylate, vinylcyclohexane monoxide, or the like.

The polymer according to the present invention can be prepared from the monomer by well known methods of copolymerizing a vinyl unsaturated group. Any polymerization methods suitable for the monomer used can be selected from, for example, radical polymerization using a radical initiator, anionic polymerization using an anion initiator, coordination anionic polymerization using a transition metal catalyst such as a Ziegler-Natta catalyst or the like, cationic polymerization using a cation initiator, and the like.

Among them, it is preferred to use a radical polymerization method from an industrial standpoint. Examples of the radical polymerization method include bulk polymerization by mixing the monomer and the radical initiator, solution polymerization in which polymerization is performed in a solvent which dissolves both the monomer and the obtained polymer, precipitation polymerization in which polymerization is performed in a solvent which dissolves the monomer but does not dissolve the obtained polymer, suspension polymerization in which polymerization is performed wherein a mixture prepared by dissolving a radical initiator in a monomer is dispersed into water, emulsion polymerization in which a monomer is emulsified in water and polymerized by using a water-soluble radical initiator, and the like. However, the polymerization method may be selected depending on needs.

In order to use the polymer as all or part of a binder constituting the layer farthest from the support on at least one side, in the case where water is used as a main component of the coating solvent, it is preferred to polymerize the polymer by emulsion polymerization, and in the case where organic solvent is used as a main component of the coating solvent, polymerization by solution polymerization using the solvent or by pearl polymerization which is a modified method of suspension polymerization can be employed.

Among these, preferred is a pearl polymerization method wherein a monomer mixed solution in which the initiator is dissolved is dispersed in an aqueous medium to have a size of about 1 mm and then polymerization is conducted upon heating followed by filtration and washing to prepare the polymer particles.

The obtained polymer can be used as all or part of the binder after dissolving it in organic solvent. The polymer can also be added into a coating solution including water as a main component after dissolving it in a water-miscible organic solvent such as tetrahydrofuran, where the mixture is dispersed in water and then decompressed to remove the remaining organic solvent followed by re-dispersion in water.

In the pearl polymerization according to the present invention, it is preferred to use water-soluble polymer such as gelatin, poly(vinyl alcohol), hydroxylethyl cellulose, poly (vinyl pyrrolidone), casein, starch, poly(acrylic acid), poly (methacrylic acid), or the like as a stabilizer. The stabilizer is preferably added within a range from 0.1% by weight to 25% by weight based on the aqueous suspension. Further, in the pearl polymerization, an inorganic salt or a surfactant may be used as a dispersing agent.

Examples of the inorganic salt include a monovalent metal salt such as sodium chloride, potassium chloride, or the like; a divalent salt such as calcium chloride, calcium carbonate, or the like; and a trivalent salt such as aluminum sulfate, or the like.

Examples of the surfactant include an anionic surfactant such as sodium dodecylbenzenesulfonate, sodium polyoxyethylene alkyl(phenyl) ether sulfate, sodium dialkylsulfosuccinate, or the like; a nonionic surfactant such as polyoxyethylene alkyl(phenyl) ether or the like; an anionic polymeric surfactant such as methacrylic acid polyoxyethylene sulfate ester sodium salt, alkyl allylsulfosuccinic acid ester sodium salt, glycerine allylnonylphenyl polyoxyethylene sulfate ammonium ether, or the like; and a nonionic polymeric surfactant such as polyoxyethylene alkylbenzene methacrylate, glycerine allylnonylphenyl polyethylene glycol ether, or the like.

The polymerization initiator used in the pearl polymerization according to the present invention is preferably an oil-soluble initiator which is soluble in the monomer, and a conventional oil-soluble compound such as a peroxide compound, an azobis compound, or the like can be employed.

Preferred examples of the polymerization initiator include 2,2'-azobis(2,4-dimethylvaleronitrile), 2,2'-azobis(isobutyronitrile), lauroyl peroxide, benzoyl peroxide, and the like. Among them, lauroyl peroxide and benzoyl peroxide are preferred because they do not generate gas during the polymerization process. If necessary, a chain transfer agent can be added in the monomer. The oil-soluble polymerization initiator is added in an amount of from 0.1 mol % to 10 mol % based on the monomer used.

In the practice of the present invention, a water-soluble polymerization initiator can be added in the aqueous medium after formation of polymer particles.

Examples of the water-soluble polymerization initiator include a persulfate such as ammonium persulfate, sodium persulfate, or potassium persulfate; an azobis polymerization initiator such as 2,2'-azobis(2-amidinopropane)dihydrochloride, 2,2'-azobis[2-(5-methyl-2-imidazolin-2-yl)propane]dihydrochloride, 2,2'-azobis[2-(2-imidazolin-2-yl)propane]dihydrochloride, or the like; and the like. The initiator may be used individually or, two or more of them may be used in combination. Particularly, a persulfate is preferred.

The addition amount of the water-soluble polymerization initiator is preferably in a range of from 0.01 parts by mass to 1.0 part by mass with respect to 100 parts by mass of the polymer particles.

In addition to the above, as a suspension stabilizer, an anionic fine particle suspension stabilizer such as silica, clay, talc, or the like; or an anionic, cationic, or nonionic surfactant such as (sulfonated) alkylaryl polyether, ethylene glycol ether of polyalcohol, carboxyalkyl-substituted polyglycol ether and ester, a sodium salt of a condensation product of naphthalene sulfonic acid and formaldehyde, a phosphate ester of glycidol polyether, a higher alcohol sulfate ester, a derivative of aliphatic acid ester of sulfosuccinic acid, a sulfate ester product of α-sulfo lower alkyl ester of aliphatic acid and glycidol polyether, or the like can be employed.

With respect to the other polymerization conditions, the reaction temperature is preferably set in a range of from 50° C. to 90° C., and more preferably from 55° C. to 85° C. Preferred is a method wherein, at first, the pre-polymerization is conducted at about 64° C. to form the polymer particles, and then the temperature is raised to 80° C. to complete the polymerization of the remaining monomer.

The coating amount of the polymer according to the present invention is preferably in a range of from 0.001 $g/m^2$ to 1 $g/m^2$, and more preferably from 0.01 $g/m^2$ to 0.5 $g/m^2$.

<Matting Agent>

The matting agent is incorporated in the outermost layer of the photothermographic material of the present invention. The surface roughness on the image forming layer side is adjusted so that convex portions having a height of 1.5 μm or higher exist in an amount of from 20 to 2,000 per 1 $mm^2$, preferably from 50 to 1,500 per 1 $mm^2$, and even more preferably from 100 to 1,000 per 1 $mm^2$. Further, it is preferred that there are few convex portions having a height of 6.0 μm or higher, and adjustment is preferably carried out so that convex portions having a height of 6.0 μm or higher exist in an amount of 10 or fewer per 1 $mm^2$, and more preferably in an amount of one or fewer per 1 $mm^2$. The above adjustment can be carried out by selecting the mean particle size, size distribution, addition amount, or the like of the matting agent used.

The measurement of height and number of the surface protrusions in the practice of the present invention can be performed by using a surface roughness measuring apparatus using a needle touching method, laser displacement measurement, an atomic force microscope, a scanning tunneling microscope, or the like. Among them, the surface roughness measuring apparatus using a needle touching method is preferred, and an apparatus based on at least one of JIS/ISO/DIN/ANSI specifications is more preferred.

The average value of the height of surface protrusions is obtained from the heights of at least 600 protrusions observed by a random sampling method. The number of surface protrusions per unit area is determined from the results of measurement over an area of at least 1 $mm^2$ in total.

The surface protrusions on the image forming layer side according to the present invention can be formed by adding a matting agent in the coating solution or causing reticulation by rapid drying after coating or the like, but it is preferable to form the surface protrusions by a matting agent.

The shape of the matting agent according to the present invention may be either a fixed form or non-fixed form. As the fixed form, a spherical shape is preferred.

The non-fixed form matting agent used in the present invention means a matting agent of a shape having no regular arrangement of a specific major plane or specific plane such as spherical, elliptical, or cubic shape, but rather having a random shape.

-Specific Examples of Matting Agent-

Concerning the non-fixed form matting agent, the component thereof is not restricted, and either an inorganic or organic substance may be employed. Specific examples include fine powder of an inorganic substance such as barium sulfate, titanium dioxide, strontium barium sulfate, silicon dioxide, or the like, and ground and classified powder of an organic polymer compound such as polytetrafluoroethylene, cellulose acetate, polystyrene, poly(methyl methacrylate), poly(ethylene carbonate), starch, or the like. Particularly, silica powder containing silicon dioxide as a main component is preferred.

-Particle Size of Matting Agent-

In the present invention, a mean particle size of the matting agent is expressed by a mean equivalent spherical diameter. The equivalent spherical diameter means a diameter of a sphere having the same volume as the volume of a matting agent particle.

The mean equivalent spherical diameter of the matting agent used in the present invention is preferably in a range of from 2.0 μm to 8 μm, and more preferably from 3.0 μm to 7.0 μm. Furthermore, the variation coefficient in the particle size distribution of the matting agent is preferably in a range of from 5% to 80%, and more preferably from 20% to 80%. The variation coefficient herein means a value expressed by (the standard deviation of particle diameter)/(mean diameter of the particle)×100.

Moreover, two or more types of matting agents having different mean particle size can be used in combination. In this case, the difference in particle size between the matting agent having the biggest mean particle size and the matting agent having the smallest mean particle size is preferably from 2 μm to 8 μm, and more preferably from 2 μm to 6 μm.

-Coating Amount of Matting Agent-

Concerning the content of the matting agent, an amount necessary for providing the surface roughness described above is selected, but the amount is influenced by various factors including physical properties such as viscosity and specific gravity of the coating solution containing the matting agent, physical properties of a coating solution for a neighboring layer which is subjected to simultaneous multilayer coating, coating conditions, drying conditions, and the like, in addition to the shape and specific gravity of the matting agent. The content of the matting agent is preferably in a range of from 0.0001 $g/m^2$ to 0.08 $g/m^2$, and more preferably from 0.001 $g/m^2$ to 0.05 $g/m^2$, when expressed in terms of a coating amount per 1 $m^2$ of the photothermographic material.

-Dispersion of Matting Agent-

The non-fixed form matting agent used in the present invention is preferably employed in the form of a dispersion of matting agent particles which is dispersed beforehand by a binder. The binder is preferably gelatin. There are two dispersing methods:

(a) a method of preparing a matting agent dispersion by making a polymer droplet by emulsified dispersion in an aqueous medium of a polymer solution prepared in advance (e.g., dissolved in an organic solvent having a low boiling point such as ethyl acetate, butyl acetate, cyclohexanone, toluene, or the like) as a matting agent and then removing the organic solvent having a low boiling point from the emulsified dispersion;

(b) a method of arranging a dispersion of fine particles of polymer or the like prepared in advance as a matting agent in an aqueous medium so as to avoid generation of lumps.

In the present invention, the method (b) which takes the environment into consideration and does not exhaust organic solvent having a low boiling point into the environment is preferable.

Dispersing methods of the matting agent described above can comprise mechanical dispersion using a known high speed stirring means (e.g., a Disbar emulsifier, a homomixer, a turbine mixer, or a homogenizer) or an ultrasonic emulsifier in the presence of aqueous medium containing a polymer or a surfactant as an auxiliary dispersing agent in an aqueous solvent in advance. During the dispersion, to prevent the occurrence of vesicles, a dispersing method which comprises dispersing the matting agent under a reduced pressure condition at less than atmospheric pressure can be used in combination with the above methods. The auxiliary dispersing agent is generally dissolved in an aqueous solvent in advance before the addition of a matting agent, but can be added as an aqueous dispersion made by polymerization of the matting agent (without a drying process). The auxiliary dispersing agent can be added in the dispersion during dispersion. The auxiliary dispersing agent can be added to the dispersion for stabilization of physical properties after dispersion. In each case, the solvent (e.g., water, alcohol, or the like) is generally made to coexist therewith. Before and after the dispersion or during dispersion, pH may be controlled by a suitable pH controlling agent.

Besides the mechanical dispersing means, stability of the matting agent dispersion after dispersion may be increased by the pH control. Further, during dispersion, a very small quantity of organic solvent having a low boiling point can be used, and in general, the organic solvent is removed after completion of the fine granulating process.

The prepared dispersion can be stored under stirring to prevent sedimentation of the matting agent during storage or can be stored in a high viscosity condition using hydrophilic colloids (e.g., in a jelly condition by using gelatin). Further, to prevent propagation of bacterium during storage, the addition of an antiseptic is preferred.

The binder is preferably added in an amount of from 5% by weight to 300% by weight with respect to the matting agent, and dispersed. More preferably, the binder is added in an amount of from 10% by weight to 200% by weight with respect to the matting agent.

<Lubricant>

To improve handling facility during manufacturing process or resistance to scratch during thermal development, it is preferred that the outermost layer contains a lubricant such as a liquid paraffin, a long chain fatty acid, an amide of a fatty acid, an ester of a fatty acid, or the like. Particularly preferred are a liquid paraffin obtained by removing components having a low boiling point and an ester of a fatty acid having a branch structure and a molecular weight of 1000 or more.

Concerning lubricants, compounds described in paragraph No. 0117 of JP-A No. 11-65021 and in JP-A Nos. 2000-5137, 2004-219794, 2004-219802, and 2004-334077 are preferable.

The addition amount of the lubricant is in a range of from 1 $mg/m^2$ to 200 $mg/m^2$, preferably from 10 $mg/m^2$ to 150 $mg/m^2$, and more preferably in a range of from 20 $mg/m^2$ to 100 $mg/m^2$.

The lubricant is added in any layer of the image forming layer and the non-image-forming layer, but from the purpose to improve transportability and resistance to scratches, it is preferred to add the lubricant in the outermost layer.

2) Non-Photosensitive Intermediate Layer

The photothermographic material of the present invention preferably has a non-photosensitive intermediate layer containing an organic silver salt, which is different from the non-photosensitive organic silver salt contained in the image forming layer, between the image forming layer and the outermost layer. The non-photosensitive intermediate layer includes a binder selected from the polymer described as the binder used for the outermost layer described above. In addition to the organic silver salt, the non-photosensitive intermediate layer can include various additives such as a polymer latex, a dye, a pigment, phthalic acids or salts thereof, and the like, which are described below.

<Organic Silver Salt Incorporated in Non-Photosensitive Intermediate Layer>

The organic silver salt, which is incorporated in the non-photosensitive intermediate layer according to the present invention, preferably includes a silver salt of a fatty acid, a silver salt of a mercapto compound, a silver salt of a nitrogen-containing heterocyclic compound, a silver salt of an aromatic carboxylic acid, and a silver salt of a poly-carboxylic acid.

The silver salt of a fatty acid is a silver salt of an aliphatic carboxylic acid which has 1 to 30 carbon atoms and may be linear or branched, and saturated or unsaturated. Preferred examples of the silver salt of a fatty acid include silver lignocerate, silver behenate, silver arachidinate, silver stearate, silver oleate, silver linoleate, silver laurate, silver capronate, silver myristate, silver palmitate, silver erucate, silver acetate, silver butyrate, silver propionate, silver valerate, silver enanthate, silver caprylate, silver pelargonate, silver decanoate, and mixtures thereof. More preferred are silver behenate, silver stearate, silver laurate, silver oleate, silver lignocerate, silver arachidinate, and mixtures thereof.

Concerning the silver salt of a mercapto compound, preferred examples of the mercapto compound include an aliphatic mercapto compound and a heterocyclic mercapto compound. In the case of the aliphatic mercapto compound, the compound preferably has 10 to 30 carbon atoms, and more preferably 10 to 25 carbon atoms. The aliphatic mercapto compound may be either linear or branched, saturated or unsaturated, and unsubstituted or substituted. In the case where the aliphatic mercapto compound has a substituent, the substituent is not particularly limited, but an alkyl group is preferred.

Preferred aliphatic group for the aliphatic mercapto compound is an alkyl group, more preferably an alkyl group having 10 to 23 carbon atoms, which include substituted or unsubstituted, and linear or branched.

Representative examples of the silver salt of an aliphatic mercapto compound are described below, but are not limited to these compounds. For example, there are included a silver salt of an alkylthiol compound having 10 to 25 carbon atoms and the like, and preferably a silver salt of an alkylthiol compound having 10 to 23 carbon atoms.

In the case of a silver salt of a heterocyclic mercapto compound, preferred examples of the heterocycle include a nitrogen-containing heterocycle, a sulfur-containing heterocycle, an oxygen-containing heterocycle, and a selenium-containing heterocycle, and more preferred are a nitrogen-containing heterocycle, a sulfur-containing heterocycle, and an oxygen-containing heterocycle. Specific examples of the silver salt of a nitrogen-containing heterocyclic mercapto compound are described below, but are not limited to these examples.

A silver salt of 3-mercapto-4-phenyl-1,2,4-triazole.

A silver salt of 2-mercapto-benzimidazole.

A silver salt of 2-mercapto-5-aminothiazole.

A silver salt of mercaptotriazine.

A silver salt of 2-mercaptobenzoxazole.

A silver salt of the compound described in U.S. Pat. No. 4,123,274 (Knight, et al) (for example, a silver salt of 1,2,4-mercaptothiazole derivative, a silver salt of 3-amino-5-benzylthio-1,2,4-thiazole), and a silver salt of a thione compound (for example, a silver salt of 3-(2-carboxyethyl)-4-methyl-4-thiazoline-2-thione described in U.S. Pat. No. 3,785,830 (Sullivan, et al)).

Concerning the silver salt of a nitrogen-containing heterocyclic compound, specific examples of the nitrogen-containing heterocyclic compound include, but are not limited to these examples, azoles, oxazoles, thiazoles, thiazolines, imidazoles, diazoles, pyridines, indolizines, and triazines. Among them, more preferred are indolizines, imidazoles, and azoles. Preferred examples of the azoles include triazole, tetrazole, and their derivatives. More preferred are benzimidazoles and derivatives thereof, and benzotriazole and derivatives thereof. Preferred example of the indolizines is a triazaindolizine derivative.

Representative examples of the nitrogen-containing heterocyclic compound further include, but are not limited to these examples, 1,2,4-triazole, benzotriazoles and derivatives thereof, and preferred are benzotriazole, methylbenzotriazole, and 5-chlorobenzotriazole. Further, 1H-tetrazole compounds such as phenylmercaptotetrazole described in U.S. Pat. No. 4,220,709 (de Mauriac), and imidazole and imidazole derivatives described in U.S. Pat. No. 4,260,677 (Winslow, et al) can be described, and benzimidazole and nitrobenzimidazole are preferred. As a triazaindolizine derivative, 5-methyl-7-hydroxy-1,3,5-triazaindolizine is preferred, but the invention is not limited to the compound.

Concerning the silver salt of an aromatic carboxylic acid, the aromatic carboxylic acid is an unsubstituted or substituted benzenecarboxylic acid where the substituent is not particularly limited. Preferred are benzoic acid and a derivative thereof, and salicylic acid and a derivative thereof.

The silver salt of a poly-carboxylic acid is a silver salt of a polyvalent carboxylic acid. A silver salt of a low-molecular poly-carboxylic acid is represented by the following formula (I).

$$M^1O_2C\text{-}L^1\text{-}CO_2M^2 \qquad \text{Formula (I)}$$

In formula (I), $L^1$ represents an alkylene group, an alkenylene group, an alkynylene group, a cycloalkylene group, an arylene group, a divalent heterocyclic group, a divalent group selected from —C(=O)—, —O—, —S—, —S(=O)—, —S(=O)$_2$—, and —N($R^1$)—, or a divalent group formed by combining these groups. $L^1$ may further have a substituent.

$R^1$ represents a hydrogen atom or a substituent. $M^1$ and $M^2$ each independently represent a hydrogen atom or a counter ion where at least one of $M^1$ and $M^2$ represents a silver ion (I). Furthermore, the compound represented by formula (I) may further have a carboxy group or a salt thereof.

Specific examples of the compound mentioned above include, but are not limited to these examples, the compounds represented by chemical formulae Nos. 2 to 16 in paragraph Nos. 0024 to 0044 of JP-A No. 2003-330139.

Preferred examples of the carboxylic acid used for forming a silver salt of a low-molecular poly-carboxylic acid include phthalic acid, isophthalic acid, terephthalic acid, malic acid, citric acid, malonic acid, succinic acid, maleic acid, fumaric acid, hemimellitic acid, trimellitic acid, trimesic acid, mellophanic acid, prehnitic acid, pyromellitic acid, oxalic acid, adipic acid, glutaric acid, pimelic acid, suberic acid, azelaic acid, sebacic acid, and naphthalenedicarboxylic acid. Among them, particularly preferred are phthalic acid, succinic acid, adipic acid, glutaric acid, and naphthalenedicarboxylic acid.

With respect to plural carboxylic acids, at least one of the carboxylic acids forms a silver salt.

A silver salt of a high-molecular poly-carboxylic acid is a silver salt of a polymer having a repeating unit derived from a monomer containing a carboxy group. Preferred compound can be represented by the following formula (II).

Formula (II)

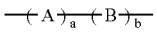

In formula (II), A represents a repeating unit derived from a monomer containing a carboxy group. B represents a repeating unit derived from an ethylenic unsaturated monomer except A. a represents a number of from 5 to 100 in terms of % by weight. b represents a number of from 0 to 95 in terms of % by weight. a+b is equal to 100% by weight. Preferably, a is a number of from 50 to 100 in terms of % by weight, b is a number of from 0 to 50 in terms of % by weight, and a+b is equal to 100% by weight.

Specifically, the detail explanations are mentioned in paragraph Nos. 0013 to 0074 of JP-A No. 2003-330137.

Specific examples of the carboxylic acid include the compounds described below, but are not limited to these examples. The silver salt formed with the said carboxylic acid is a silver salt of a high-molecular poly-carboxylic acid, which may have at least one silver carboxylate in a molecule.

P-1

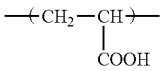

Mw = 46000

P-2

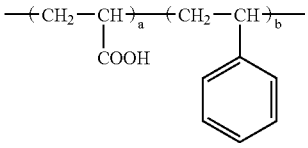

a/b = 80/20
Mw = 37000

P-3

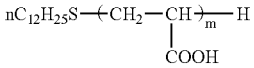

m = 5.1

P-4

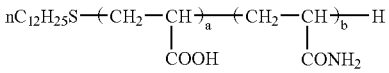

a/b = 75/25
m = 14.6

P-5

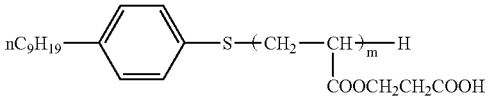

m = 5.2

P-6

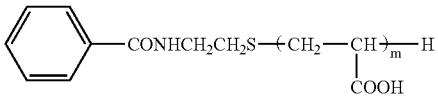

m = 13.2

Among the organic silver salts described above, preferred examples of the silver salt of a fatty acid include silver behenate, silver stearate, silver laurate, silver oleate, silver lignocerate, and silver arachidinate. Preferred examples of the silver salt of a mercapto compound include a silver salt of 3-mercapto-4-phenyl-1,2,4-triazole, a silver salt of 2-mercaptobenzimidazole, and a silver salt of 2-mercapto-5-aminothiazole. Preferred examples of the silver salt of a nitrogen-containing heterocyclic compound include silver salt of benzotriazole, silver salt of methylbenzotriazole, silver salt of benzimidazole, silver salt of nitrobenzimidazole, and silver salt of 5-methyl-7-hydroxy-1,3,5-triazaindolizine. Preferred examples of the silver salt of a poly-carboxylic acid include silver phthalate, silver succinate, silver adipate, silver glutarate, and silver naphthalenedicarboxylate. Preferred examples of the silver salt of a high-molecular poly-carboxylic acid include a silver salt of the compound selected from P-1, P-3, and P-5 mentioned above.

Among them, particularly preferred are silver salt of benzotriazole and silver salt of methylbenzotriazole.

Syntheses of the silver salt of a fatty acid and the silver salt of an aliphatic mercapto compound can be carried out according to the conventional methods known in the art. For example, an aliphatic mercapto compound is melted in water by heating at a temperature above the melting point (generally, from 10° C. to 90° C.), and then a sodium salt thereof is formed with sodium hydroxide. Thereafter, the sodium salt is reacted with silver nitrate to form crystal of a silver salt of an aliphatic mercapto compound. The obtained silver salt can be dispersed using a suitable dispersing agent to prepare a dispersion thereof. In this preparing process for forming crystal of a silver salt of a fatty acid or a silver salt of an aliphatic mercapto compound, dispersion of the silver salt of a fatty acid or silver salt of an aliphatic mercapto compound may be performed in the presence of hydrophilic colloid such as gelatin. Another method for bringing the silver salt comprises a step of adding a fatty acid or an aliphatic mercapto compound in a reaction vessel and thereto adding silver nitrate.

A silver salt of a heterocyclic mercapto compound and a silver salt of a low-molecular poly-carboxylic acid can be prepared similarly. As an alternative method, for example, preparation can be easily performed for technician in the art, according to the method described in "Jikken Kagaku Koza" (Lecture Series on Experimental Chemistry), 4th Ed, vol. 22, pp. 1 to 43, and pp. 193 to 227, edited by the Chemical Society of Japan, and the references cited above. A silver salt of a nitrogen-containing heterocyclic compound and a silver salt of a heterocyclic mercapto compound can also be prepared by the method described in JP-A No. 1-100177. The silver salt of a high-molecular poly-carboxylic acid can be also synthesized by a method similar to the method described above.

The addition amount of the organic silver salt added in the non-photosensitive layer according to the present invention is from 0.001 g/m$^2$ to 3 g/m$^2$, in terms of a silver amount, preferably from 0.005 g/m$^2$ to 1 g/m$^2$, and more preferably from 0.01 g/m$^2$ to 0.5 g/m$^2$.

3) Latex-Containing Intermediate Layer

The photothermographic material of the present invention preferably has a latex-containing intermediate layer, in which 50% by weight or more of the binder is a hydrophobic polymer latex, between the image forming layer and the outermost layer, or between the image forming layer and the non-photosensitive layer containing the non-photosensitive organic silver salt in the case where the photothermographic material has a non-photosensitive layer containing a non-photosensitive organic silver. Besides the polymer latex, the binder includes a hydrophilic binder such as gelatin, poly(vinyl alcohol), or the like.

In the invention, there is no particular restriction concerning the latex polymer, but as the latex polymer, hydrophobic polymer such as acrylic polymer, polyesters, rubbers (e.g., SBR resin), polyurethanes, poly(vinyl chlorides), poly(vinyl acetates), poly(vinylidene chlorides), polyolefins, or the like can be used preferably. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

The latex polymer according to the present invention preferably has a grass transition temperature (Tg) in a range of from −30° C. to 70° C., more preferably, in a range of from −10° C. to 35° C., and most preferably in a range of from 0° C. to 35° C. When Tg is lower than −30° C., film-forming property is excellent but resistance strength to heat of the film becomes weak. When Tg is higher than 70° C., resistance strength to heat is excellent but film-forming property of the film becomes insufficient. It is possible to use two or more types of polymer in order to adjust Tg within the above range. Even if a polymer having Tg outside of the above range is used, it is preferred that the weight-average Tg is within the range mentioned above.

The coating amount of hydrophobic polymer in the latex-containing intermediate layer is preferably from 0.1 g/m$^2$ to 10 g/m$^2$, more preferably from 0.3 g/m$^2$ to 7 g/m$^2$, and most preferably from 0.5 g/m$^2$ to 5 g/m$^2$.

4) Coating Amount of Gelatin

In the invention, 50% by weight or more of the binder of at least one non-photosensitive layer on the side having the image forming layer is gelatin. As gelatin, various types of gelatin such as lime-processed gelatin, acid-processed gelatin, or the like can be used. To maintain the function of binder in a good state, it is preferred to use gelatin having a molecular weight of from 10,000 to 1,000,000.

5) Polymer Latex

The photothermographic material of the present invention preferably contains a polymer latex in a non-photosensitive layer on the side having the image forming layer or on the backside. The polymer latex can be preferably selected from those described in the explanation of the polymer latex used for the intermediate layer mentioned above.

Other than these, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there are mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like. Furthermore, as the binder for the surface protective layer, there may be applied the technology described in paragraph Nos. 0021 to 0025 of the specification of JP-A No. 2000-267226, and the technology described in paragraph Nos. 0023 to 0041 of the specification of JP-A No. 2000-19678.

It is particularly preferred that the polymer latex is contained in a layer containing gelatin as the binder. When the polymer latex is contained in the non-photosensitive layer on the side having the image forming layer, it is preferred to add the polymer latex in an amount of from 1% by weight to 50% by weight with respect to the amount of gelatin. When the polymer latex is contained in the non-photosensitive layer on the backside, it is preferred to add the polymer latex in an amount of from 5% by weight to 50% by weight with respect to the amount of gelatin.

(Dye)

The photothermographic material of the present invention preferably contains a dye. The dye according to the present invention has effects on preventing halation, preventing irradiation, or adjusting color tone.

The dye which can be used in the present invention is preferably a metal phthalocyanine dye represented by formula (PC-1).

Formula (PC-1)

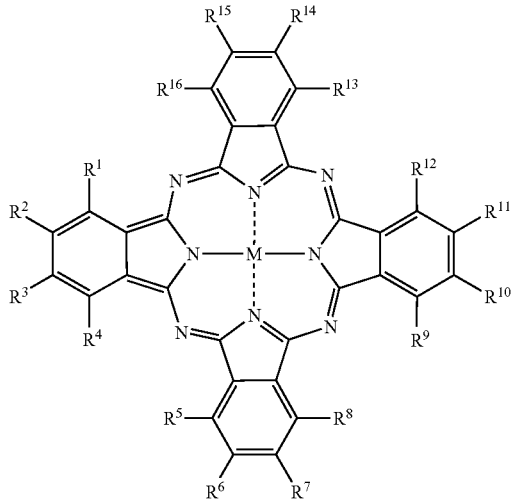

In formula (PC-1), M represents a metal atom. The metal atom may be any metal as long as it forms a stable complex, and a metal selected from the group consisting of Li, Na, K, Be, Mg, Ca, Ba, Al, Si, Cd, Hg, Cr, Fe, Co, Ni, Cu, Zn, Ge, Pd, Sn, Pt, Pb, Sr, or Mn can be used. Mg, Ca, Co, Zn, Pd, or Cu is preferably used, more preferably, Co, Pd, Zn, or Cu is used, and particularly preferably, Cu is used.

In formula (PC-1), $R^1$, $R^4$, $R^5$, $R^8$, $R^9$, $R^{12}$, $R^{13}$, and $R^{16}$ each independently represent a hydrogen atom, a substituent, or an electron-attracting group, and at least one of $R^1$, $R^4$, $R^5$, $R^8$, $R^9$, $R^{12}$, $R^{13}$, and $R^{16}$ is an electron-attracting group.

The electron-attracting group herein is a group selected from the group consisting of a halogen atom, a cyano group, a nitro group, and groups represented by —C(=O)—R, —C(=O)—C(=O)—R, —S(=O)—R, —S(=O)$_2$—R, —C(=N—R')—R, —S(=NR')—R, —S(=NR')$_2$—R, —P(=O)R$_2$, —O—R", —S—R", —N(—R')—C(=O)—R, —N(—R')—S(=O)—R, —N(—R')—S(=O)$_2$—R, —N(—R')—C(=N—R')—R, —N(—R')—S(=NR')$_2$—R, or —N(—R')—P(=O)R$_2$. Herein R represents one selected from a hydrogen atom, an alkyl group, an aryl group, a heterocyclic group, an amino group, an alkyloxy group, an aryloxy group, a heterocyclic oxy group, a hydroxy group, an alkylthio group, an arylthio group, a heterocyclic thio group, or an SH group. R' represents one selected from a hydrogen atom, an alkyl group, an aryl group, a heterocyclic group, an acyl group, a sulfonyl group, a sulfinyl group, or a phosphoryl group. R" represents one selected from a perfluoro alkyl group, a cyano group, an acyl group, a sulfonyl group, or a sulfinyl group.

The groups represented by R, R', and R" may be substituted by a substituent. Specific examples of the substituent include a halogen atom (a fluorine atom, a chlorine atom, a bromine atom, or an iodine atom), an alkyl group (including an aralkyl group, a cycloalkyl group, an active methine group, and the like), an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, an acylamino group, a sulfonamide group, an ureido group, a thioureido group, an imide group, an alkoxycarbonylamino group, an aryloxycarbonylamino group, a sulfamoylamino group, a semicarbazide group, a thiosemicarbazide group, a hydrazino group, an ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, a group containing a phosphoric amide structure or a phosphate ester structure), a silyloxy group (for example, trimethylsilyloxy, or t-butyldimethylsilyloxy), a silyl group (for example, trimethylsilyl, t-butyldimethylsilyl, or phenyldimethylsilyl), and the like. These substituents may be further substituted by these substituents.

In formula (PC-1), a group represented by formula (II) is preferably used as an electron-attracting group.

$$-L^1-R^{17} \qquad \text{Formula (II)}$$

$L^1$ represents a group selected from **—SO$_2$—*, **—SO$_3$—*, **—SO$_2$NR$_N$—*, **—SO—*, **—CO—*, **—CONR$_N$—*, **—COO—*, **—COCO—*, **—COCO$_2$—*, or **—COCONR$_N$—*. ** denotes a bond with a phthalocyanine skeleton at this position. * denotes a bond with $R^{17}$ at this position. $R_N$ represents one selected from a hydrogen atom, an alkyl group, an aryl group, a heterocyclic group, an acyl group, an alkoxycarbonyl group, a carbamoyl group, a sulfonyl group, or a sulfamoyl group. $R_N$ may further be substituted by a substituent which $R_1$, $R_2$, $R_3$, $R_4$, $R_5$, $R_6$, $R_7$, and $R_8$ in formula (PC-1) may have. $L^1$ is preferably **—SO$_2$—*, **—SO$_2$NR$_N$—*, **—CO—*, **—CONR$_N$—*, or **—COO—*, more preferably, **—SO$_2$—*, **—SO$_2$NR$_N$—*, or **—CONR$_N$—*, and particularly preferably, **—SO$_2$—* or **—SO$_2$NR$_N$—*.

$R_N$ is preferably a hydrogen atom, an alkyl group, an aryl group, or a heterocyclic group, more preferably a hydrogen atom, an alkyl group having 1 to 20 carbon atoms, an aryl group having 6 to 20 carbon atoms, or a heterocyclic group having 1 to 20 carbon atoms, even more preferably a hydrogen atom, an alkyl group having 1 to 10 carbon atoms, an aryl group having 6 to 10 carbon atoms, or a heterocyclic group having 1 to 10 carbon atoms, and particularly preferably a hydrogen atom or an alkyl group having 1 to 6 carbon atoms.

$R^{17}$ represents one selected from a hydrogen atom, an alkyl group, an aryl group, or a heterocyclic group. In the case where $R^{17}$ represents an alkyl group, an aryl group or a heterocyclic group, these groups may be further substituted by substituents which $R^1$, $R^4$, $R^5$, $R^8$, $R^9$, $R^{12}$, $R^{13}$, or $R^{16}$ in formula (PC-1) can have. $R^{17}$ is preferably an alkyl group or an aryl group, and particularly preferably an alkyl group. $R^{17}$ has 1 to 30 carbon atoms, preferably 1 to 20 carbon atoms, and more preferably 1 to 10 carbon atoms.

$R^{17}$ is preferably substituted by a hydrophilic group. Herein, a hydrophilic group indicates a carboxy group, a sulfo group, a phosphate group, a group having a structure of quaternary salt of nitrogen, a group having a structure of quaternary salt of phosphorus, or a group in which ethylene oxy group units are repeated. In the case where the hydrophilic group is a carboxy group, a sulfo group, or a phosphate group, the hydrophilic group may have a counter cation, when necessary. As the counter cation, a metal cation, an ammonium ion, a group having a structure of quaternary salt of nitrogen, or a group having a structure of a quaternary salt of phosphorus is used. In the case where W is a group having a structure of quaternary salt of nitrogen, or a group having a structure of quaternary salt of phosphorus, W may have a counter anion, when necessary. As examples of the counter anion, a halogen ion, a sulfate ion, a nitrate ion, a phosphate ion, an oxalate ion, an alkanesulfonate ion, an arylsulfonate ion, an alkanecarboxylate ion, an arylcarboxylate ion, and the like can be described. The hydrophilic group is preferably a carboxy group, a sulfo group, or a phosphate group, and more preferably, a carboxy group or a sulfo group. In this case, as a counter cation, $Li^+$, $Na^+$, $K^+$, $Mg^{2+}$, $Ca^{2+}$ or $NH_4^+$ is preferably used, more preferably, $Li^+$, $Na^+$, $K^+$ or $NH_4^+$ is used, and particularly preferably, $Li^+$ or $Na^+$ is used.

In formula (PC-1), when $R^1$, $R^4$, $R^5$, $R^8$, $R^9$, $R^{12}$, $R^{13}$, or $R^{16}$ is a substituent, the substituent can be a substituent selected from the same group as R, R', or R" in formula (PC-1) can have. These substituents may be further substituted by these substituents.

The substituents are preferably a halogen atom, an alkyl group, an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a sulfonyloxy group, an imide group, a sulfamoylamino group, a semicarbazide group, a thiosemicarbazide group, a nitro group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, or a group containing a phosphoric amide structure or a phosphate ester structure. More preferably, an alkyl group, an aryl group, a heterocyclic group, an acyl group, an alkoxycarbonyl group, a carbamoyl group, a carboxy group or a salt thereof, an oxalyl group, an oxamoyl group, a cyano group, an imide group, a sulfamoylamino group, an alkylsulfonyl group, an arylsulfonyl group, an alkylsulfinyl group, an arylsulfinyl group, a sulfo group or a salt thereof, a sulfamoyl group, an acylsulfamoyl group, or a sulfonylsulfamoyl group or a salt thereof is used.

Even more preferably, an aryl group, a heterocyclic group, an acyl group, an alkoxycarbonyl group, a carbamoyl group, a carboxy group or a salt thereof, an alkylsulfonyl group, an arylsulfonyl group, an alkylsulfinyl group, an arylsulfinyl group, a sulfo group or a salt thereof, or a sulfamoyl group is used.

In the compound represented by formula (PC-1), preferably, four or more from among $R^1$, $R^4$, $R^5$, $R^8$, $R^9$, $R^{12}$, $R^{13}$, and $R^{16}$ are each independently a group represented by formula (II), and more preferably, at least one of R in each combination of $R^1$ and $R^4$, $R^5$ and $R^8$, $R^9$ and $R^{12}$, and $R^{13}$ and $R^{16}$ is a group represented by formula (II). Particularly preferably, one of R in each combination of $R^1$ and $R^4$, $R^5$ and $R^8$, $R^9$ and $R^{12}$, and $R^{13}$ and $R^{16}$ is a group represented by formula (II), and the other is a hydrogen atom. When a plural number of groups represented by formula (II) are present in a same molecule, these may be identical or different from one another.

In formula (PC-1), $R^2$, $R^3$, $R^6$, $R^7$, $R^{10}$, $R^{11}$, $R^{14}$, and $R^{15}$ each independently represent a hydrogen atom or a substituent. Herein, the substituent is selected from the same range as $R^1$, $R^4$, $R^5$, $R^8$, $R^9$, $R^{12}$, $R^{13}$, and $R^{16}$ in formula (PC-1) can have.

$R^2$, $R^3$, $R^6$, $R^7$, $R^{10}$, $R^{11}$, $R^{14}$, and $R^{15}$ are preferably a hydrogen atom, a halogen atom, a carboxy group, an alkoxycarbonyl group, an acyl group, a sulfo group, a sulfamoyl group, a sulfonyl group, an alkyl group, an aryl group, or a heterocyclic group.

More preferable are a hydrogen atom, a halogen atom, a sulfo group, a sulfamoyl group, and a sulfonyl group, and particularly preferable are a hydrogen atom, a sulfo group, and a halogen atom.

Particularly preferably, $R^2$, $R^3$, $R^6$, $R^7$, $R^{10}$, $R^{11}$, $R^{14}$, and $R^{15}$ are each a hydrogen atom, and at least one of $R^1$, $R^4$, $R^5$, $R^8$, $R^9$, $R^{12}$, $R^{13}$, and $R^{16}$ is a group represented by formula (II). More preferably, $R^2$, $R^3$, $R^6$, $R^7$, $R^{10}$, $R^{11}$, $R^{14}$, and $R^{15}$ are each a hydrogen atom, and four or more from among $R^1$, $R^4$, $R^5$, $R^8$, $R^9$, $R^{12}$, $R^{13}$, and $R^{16}$ are each independently a group represented by formula (II).

In general, phthalocyanine compounds having a plural number of substituents may have a regioisomer, in which the substituents have different bonding positions.

The compounds represented by formula (PC-1) in the invention are not exceptional. In some cases several regioisomers may be present. In the invention, the phthalocyanine compound may be used as a single compound but it may be used as a mixture of regioisomers. In the case where a mixture of regioisomers is used, any number of regioisomers, any substitution position in the isomer, and any ratio of isomers may be employed.

Examples of the compound represented by formula (PC-1) used in the present invention are shown below. However, the present invention is not limited by these examples. In the following examples of the compound, mixtures of regioisomers are described as a single compound.

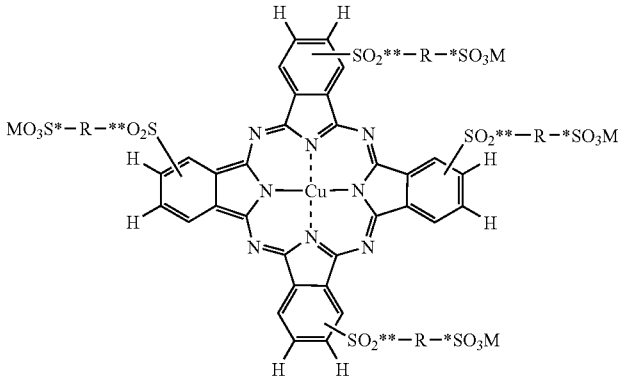

| | | Compound No. | | |
|---|---|---|---|---|
| | | M = Li | M = Na | M = K |
| **—R—* = | **—$CH_2CH_2$—* | 1 | 10 | 19 |
| | **—$CH_2CH_2CH_2$—* | 2 | 11 | 20 |
| | **—$CH_2CH_2CH_2CH_2$—* | 3 | 12 | 21 |
| | **—$CH_2CH_2CH_2CH_2CH_2$—* | 4 | 13 | 22 |
| | **—$CH_2CH_2$—$(OCH_2CH_2)n$—* | | | |
| | n = 1 | 5 | 14 | 23 |
| | 2 | 6 | 15 | 24 |
| | 3 | 7 | 16 | 25 |
| | 4 | 8 | 17 | 26 |
| | 5 | 9 | 18 | 27 |

-continued
| | Compound No. | |
|---|---|---|
| | M = Li | M = Na |
| 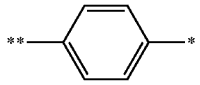 | 28 | 31 |
| 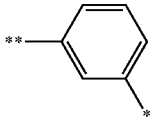 | 29 | 32 |
| 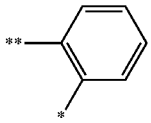 | 30 | 33 |
| | Compound No. | |
|---|---|---|
| | M = Li | M = Na |
| 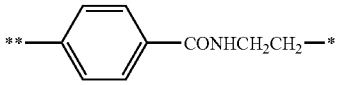 | 34 | 37 |
| 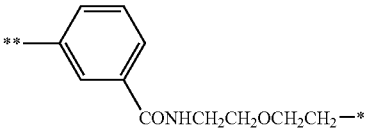 | 35 | 38 |
| 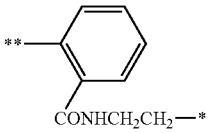 | 36 | 39 |
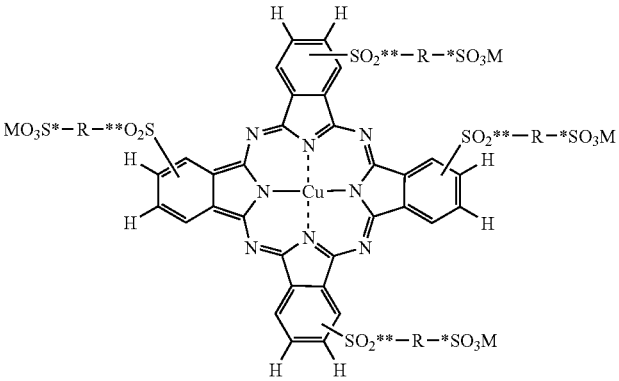
| | | Compound No. | |
|---|---|---|---|
| **—R—* = | **—$CH_2CH_2$—* | 40 | M = Li & $NH_4$ (Li/$NH_4$ = 3/1) |
| | | 41 | M = Li & $NH_4$ (Li/$NH_4$ = 2/2) |
| | | 42 | M = Na & $NH_4$ (Na/$NH_4$ = 3/1) |
| | | 43 | M = Na & $NH_4$ (Na/$NH_4$ = 2/2) |
| | | 44 | M = Na & $NH_4$ (Na/$NH_4$ = 1/3) |
| | **—$CH_2CH_2CH_2$—* | 45 | M = Li & $NH_4$ (Li/$NH_4$ = 3/1) |
| | | 46 | M = Li & $NH_4$ (Li/$NH_4$ = 2/2) |
| | | 47 | M = Li & $NH_4$ (Li/$NH_4$ = 1/3) |
| | | 48 | M = Na & $NH_4$ (Na/$NH_4$ = 3/1) |
| | | 49 | M = Na & $NH_4$ (Na/$NH_4$ = 2/2) |
| | | 50 | M = Na & $NH_4$ (Na/$NH_4$ = 1/3) |
| | | 51 | M = K & $NH_4$ (K/$NH_4$ = 3/1) |

-continued
| | | |
|---|---|---|
| | 52 | M = K & $NH_4$ ($K/NH_4$ = 2/2) |
| | 53 | M = K & $NH_4$ ($K/NH_4$ = 1/3) |
| | 54 | M = $Et_4N$ |
| **—$CH_2CH_2CH_2CH_2$—* | 55 | M = Li & $NH_4$ ($Li/NH_4$ = 3/1) |
| | 56 | M = Li & $NH_4$ ($Li/NH_4$ = 2/2) |
| | 57 | M = Na & $NH_4$ ($Na/NH_4$ = 3/1) |
| | 58 | M = Na & $NH_4$ ($Na/NH_4$ = 2/2) |
| | 59 | M = Na & $NH_4$ ($Na/NH_4$ = 1/3) |
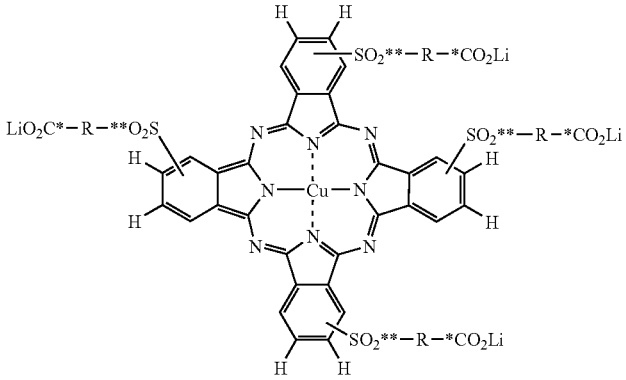
| | | Compound No. |
|---|---|---|
| **—R—* = | **—$CH_2CH_2$—* | 60 |
| | **—$CH_2CH_2CH_2$—* | 61 |
| | **—$CH_2CH_2CH_2CH_2$—* | 62 |
| | **—$CH_2CH_2CH_2CH_2CH_2$—* | 63 |
| | **—$CH_2CH_2$—($OCH_2CH_2$)n-* | 64 |
| | n = 1 | 65 |
| | 2 | 66 |
| | 3 | 67 |
| | 4 | 68 |
| | 5 | 69 |
| | Compound No. | | Compound No. |
|---|---|---|---|
| 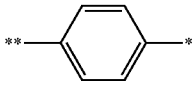 | 70 | 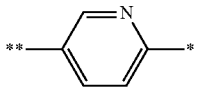 | 73 |
| 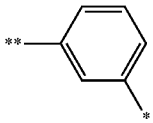 | 71 | 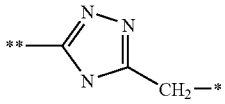 | 74 |
| 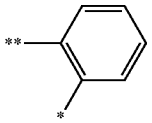 | 72 | 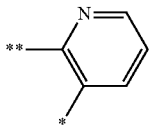 | 75 |

-continued
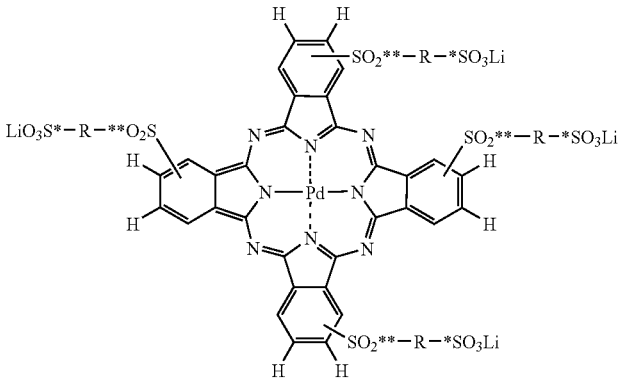
| | | Compound No. |
|---|---|---|
| **—R—* = | **—$CH_2CH_2$—* | 76 |
| | **—$CH_2CH_2CH_2$—* | 77 |
| | **—$CH_2CH_2CH_2CH_2$—* | 78 |
| | **—$CH_2CH_2CH_2CH_2CH_2$—* | 79 |
| | **—$CH_2CH_2$—($OCH_2CH_2$)n-* | |
| | n = 1 | 80 |
| | 2 | 81 |
| | 3 | 82 |
| | 4 | 83 |
| | 5 | 84 |
| | Compound No. | | Compound No. |
|---|---|---|---|
| 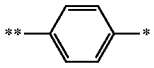 | 85 | 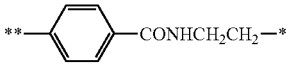 | 88 |
| 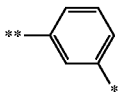 | 86 | 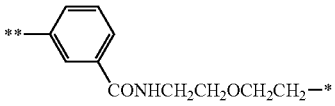 | 89 |
| 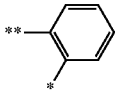 | 87 | 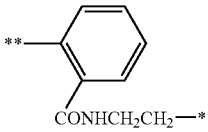 | 90 |
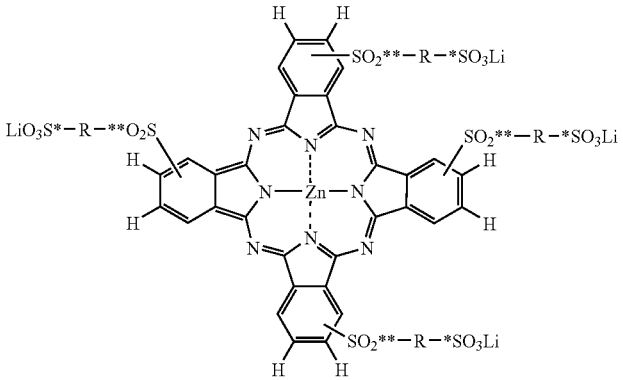
| | | Compound No. |
|---|---|---|
| **—R—* = | **—$CH_2CH_2$—* | 91 |
| | **—$CH_2CH_2CH_2$—* | 92 |
| | **—$CH_2CH_2CH_2CH_2$—* | 93 |
| | **—$CH_2CH_2CH_2CH_2CH_2$—* | 94 |
| | **—$CH_2CH_2$—($OCH_2CH_2$)n-* | |

-continued
| | |
|---|---|
| n = 1 | 95 |
| 2 | 96 |
| 3 | 97 |
| 4 | 98 |
| 5 | 99 |
| | Compound No. | | Compound No. |
|---|---|---|---|
| 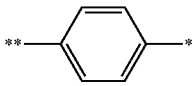 | 100 | 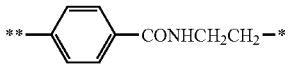 | 103 |
| 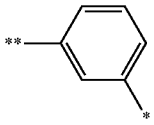 | 101 | 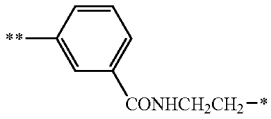 | 104 |
| 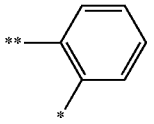 | 102 | 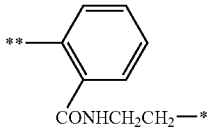 | 105 |
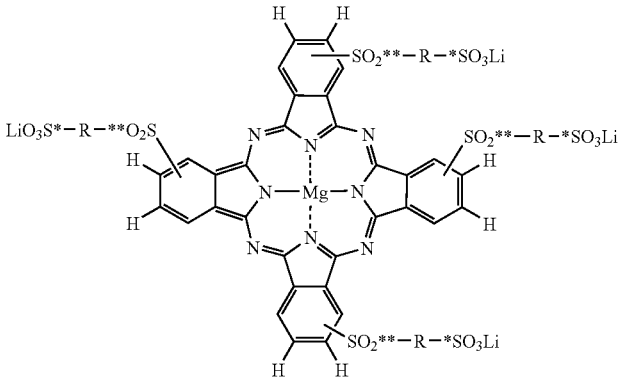
| | | Compound No. |
|---|---|---|
| **—R—* = | **—$CH_2CH_2$—* | 106 |
| | **—$CH_2CH_2CH_2$—* | 107 |
| | **—$CH_2CH_2CH_2CH_2$—* | 108 |
| | **—$CH_2CH_2CH_2CH_2CH_2$—* | 109 |
| | **—$CH_2CH_2$—$(OCH_2CH_2)$n-* | |
| | n = 1 | 110 |
| | 2 | 111 |
| | 3 | 112 |
| | 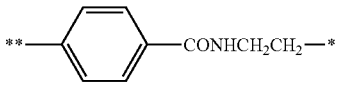 | 113 |
| | 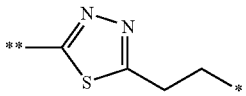 | 114 |
| | 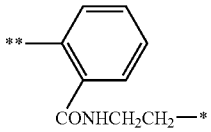 | 115 |

-continued
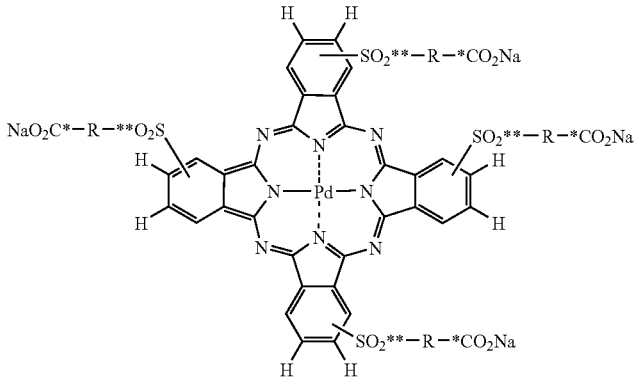
| | | Compound No. |
|---|---|---|
| **—R—* = | **—$CH_2CH_2CH_2$—* | 116 |
| | **—$CH_2CH_2CH_2CH_2$—* | 117 |
| | **—$CH_2CH_2CH_2CH_2CH_2$—* | 118 |
| | **—$CH_2CH_2$—$(OCH_2CH_2)$n-* | |
| | n = 1 | 119 |
| | 2 | 120 |
| | 3 | 121 |
| | Compound No. | | Compound No. |
|---|---|---|---|
| 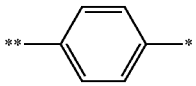 | 122 | 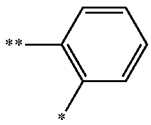 | 124 |
| 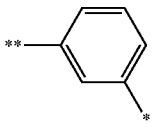 | 123 | 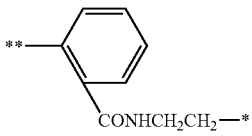 | 125 |
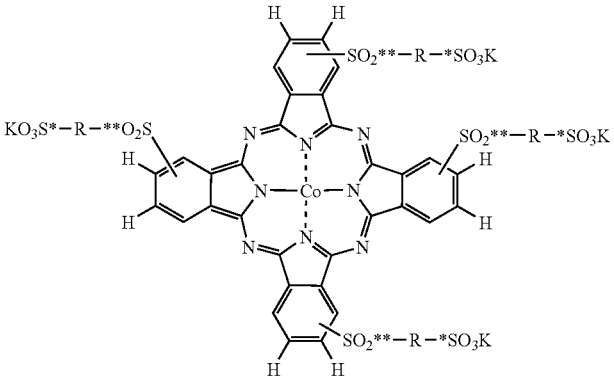
| | | Compound No. |
|---|---|---|
| **—R—* = | **—$CH_2CH_2CH_2$—* | 126 |
| | **—$CH_2CH_2CH_2CH_2$—* | 127 |
| | **—$CH_2CH_2CH_2CH_2CH_2$—* | 128 |
| | **—$CH_2CH_2$—$(OCH_2CH_2)$n-* | |
| | n = 1 | 129 |
| | 2 | 130 |
| | 3 | 131 |

-continued
| Compound No. | | Compound No. | |
|---|---|---|---|
| 132 | 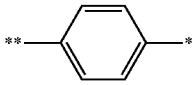 | 134 | 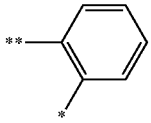 |
| 133 | 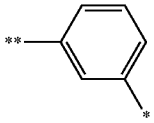 | 135 | 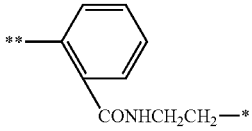 |
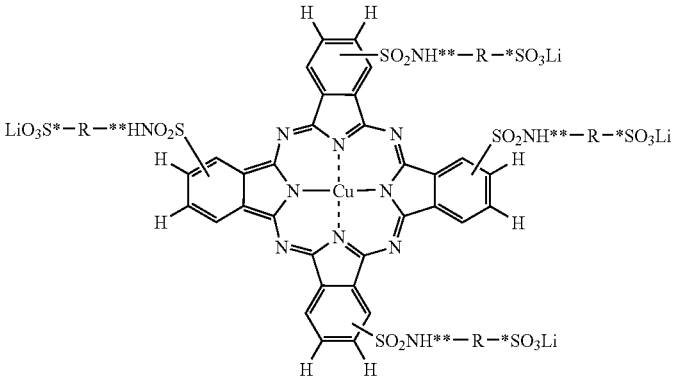
| | | Compound No. |
|---|---|---|
| **—R—* = | **—$CH_2CH_2$—* | 136 |
| | **—$CH_2CH_2CH_2$—* | 137 |
| | **—$CH_2CH_2CH_2CH_2$—* | 138 |
| | **—$CH_2CH_2CH_2CH_2CH_2$—* | 139 |
| | **—$CH_2CH_2$—$(OCH_2CH_2)$n-* | |
| | n = 1 | 140 |
| | 2 | 141 |
| | 3 | 142 |
| Compound No. | | Compound No. | |
|---|---|---|---|
| 143 | 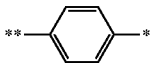 | 146 | 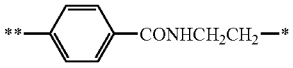 |
| 144 | 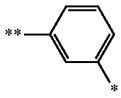 | 147 | 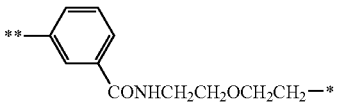 |
| 145 | 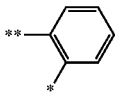 | 148 | 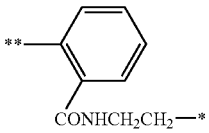 |

-continued
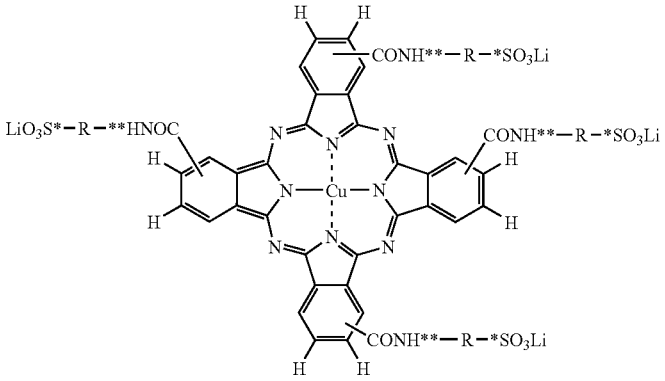
| | | Compound No. |
|---|---|---|
| **—R—* = | **—$CH_2CH_2$—* | 149 |
| | **—$CH_2CH_2CH_2$—* | 150 |
| | **—$CH_2CH_2CH_2CH_2$—* | 151 |
| | **—$CH_2CH_2CH_2CH_2CH_2$—* | 152 |
| | **—$CH_2CH_2$—$(OCH_2CH_2)n$-* | |
| | n = 1 | 153 |
| | 2 | 154 |
| | 3 | 155 |
| | Compound No. | | Compound No. |
|---|---|---|---|
| 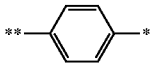 | 156 | 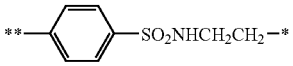 | 159 |
| 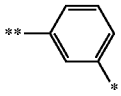 | 157 | 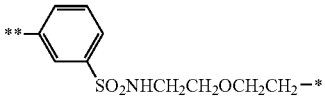 | 161 |
| 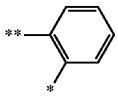 | 158 | 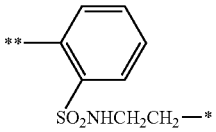 | 162 |
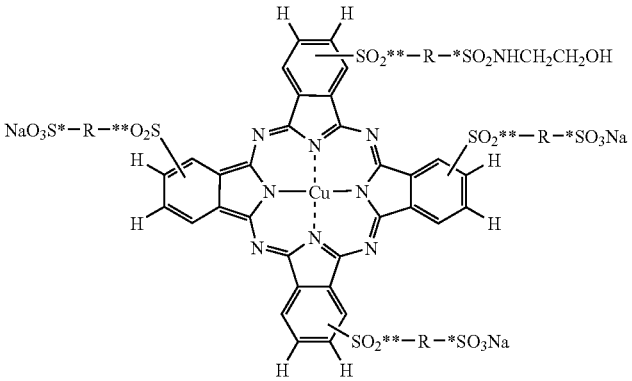
| | | Compound No. |
|---|---|---|
| **—R—* = | **—$CH_2CH_2CH_2$—* | 163 |
| | **—$CH_2CH_2CH_2CH_2$—* | 164 |
| | **—$CH_2CH_2CH_2CH_2CH_2$—* | 165 |
| | **—$CH_2CH_2$—$(OCH_2CH_2)n$-* | |

-continued
| | |
|---|---|
| n = 1 | 166 |
| 2 | 167 |
| 3 | 168 |
| Compound No. | | Compound No. | |
|---|---|---|---|
| 169 | 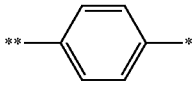 | 171 | 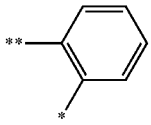 |
| 170 | 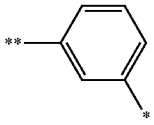 | 172 | 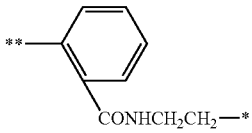 |
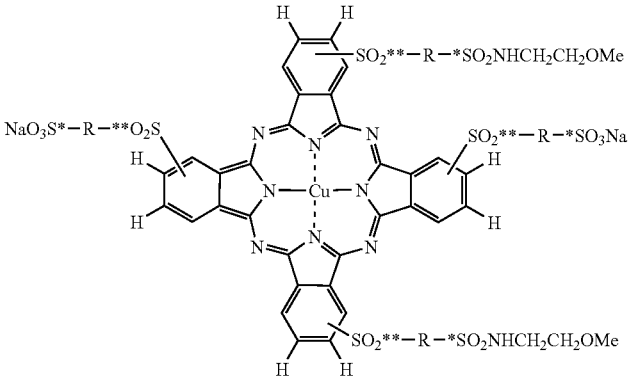
| | | Compound No. |
|---|---|---|
| **—R—* = | **—$CH_2CH_2CH_2$—* | 173 |
| | **—$CH_2CH_2CH_2CH_2$—* | 174 |
| | **—$CH_2CH_2CH_2CH_2CH_2$—* | 175 |
| | **—$CH_2CH_2$—$(OCH_2CH_2)$n-* | |
| | n = 1 | 176 |
| | 2 | 177 |
| | 3 | 178 |
| | 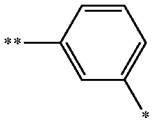 | 179 |
| | 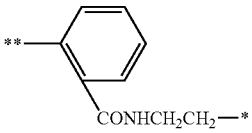 | 180 |

-continued
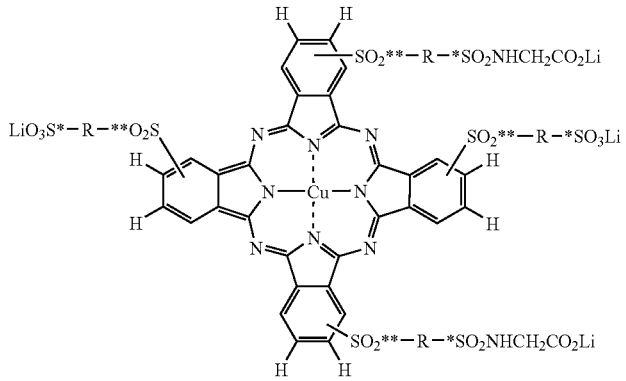
| | | Compound No. |
|---|---|---|
| **—R—* = | **—$CH_2CH_2CH_2$—* | 181 |
| | **—$CH_2CH_2CH_2CH_2$—* | 182 |
| | **—$CH_2CH_2CH_2CH_2CH_2$—* | 183 |
| | **—$CH_2CH_2$—$(OCH_2CH_2)$n-* | |
| | n = 1 | 184 |
| | 2 | 185 |
| | 3 | 186 |
| | 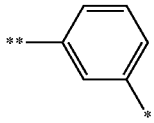 | 187 |
| | 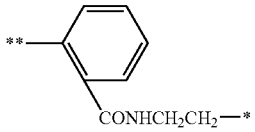 | 188 |
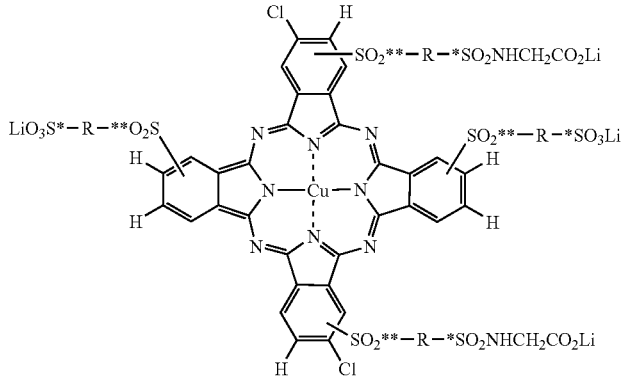
| | | Compound No. |
|---|---|---|
| **—R—* = | **—$CH_2CH_2CH_2$—* | 189 |
| | **—$CH_2CH_2CH_2CH_2$—* | 190 |
| | **—$CH_2CH_2CH_2CH_2CH_2$—* | 191 |
| | 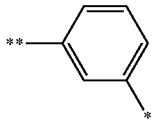 | 192 |

-continued
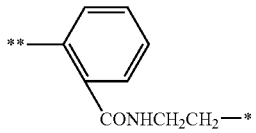
193
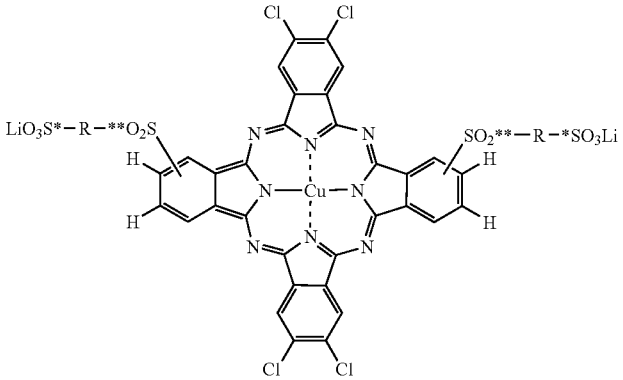
| | | Compound No. |
|---|---|---|
| **—R—* = | **—$CH_2CH_2CH_2$—* | 194 |
| | **—$CH_2CH_2CH_2CH_2$—* | 195 |
| | **—$CH_2CH_2CH_2CH_2CH_2$—* | 196 |
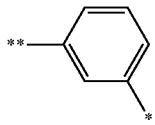
197
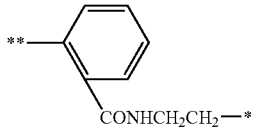
198
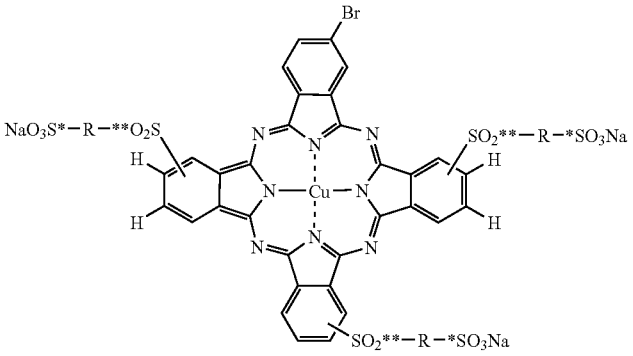
| | | Compound No. |
|---|---|---|
| **—R—* = | **—$CH_2CH_2CH_2$—* | 199 |
| | **—$CH_2CH_2CH_2CH_2$—* | 200 |
| | **—$CH_2CH_2CH_2CH_2CH_2$—* | 201 |

-continued
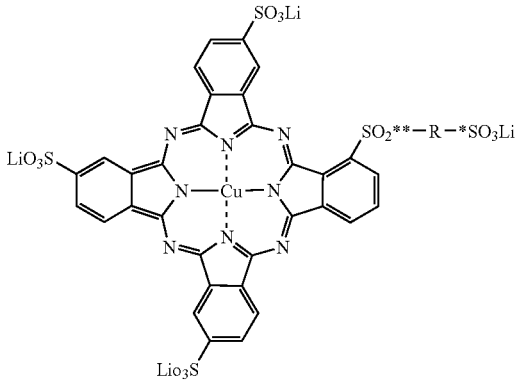
| | | Compound No. |
|---|---|---|
| **—R—* = | **—$CH_2CH_2CH_2$—* | 202 |
| | **—$CH_2CH_2CH_2CH_2$—* | 203 |
| | **—$CH_2CH_2CH_2CH_2CH_2$—* | 204 |
| | 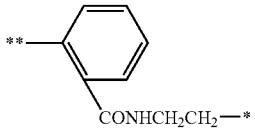 | 205 |
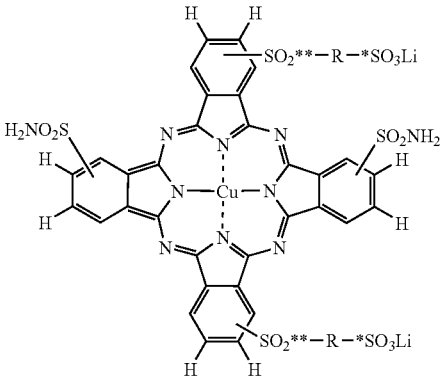
| | | Compound No. |
|---|---|---|
| **—R—* = | **—$CH_2CH_2$—* | 206 |
| | **—$CH_2CH_2CH_2$—* | 207 |
| | **—$CH_2CH_2CH_2CH_2$—* | 208 |
| | **—$CH_2CH_2CH_2CH_2CH_2$—* | 209 |
| | **—$CH_2CH_2$—$(OCH_2CH_2)n$-* | |
| | n = 1 | 210 |
| | 2 | 211 |
| | 3 | 212 |

-continued

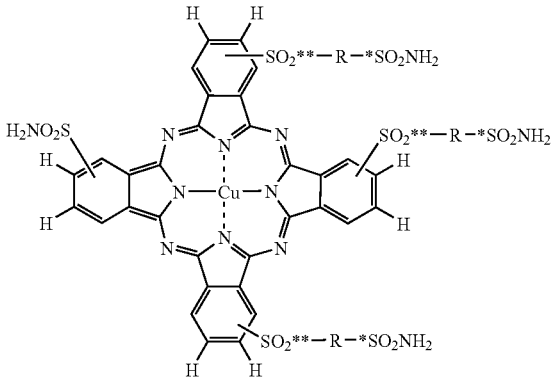

| | | Compound No. |
|---|---|---|
| **—R—* = | **—$CH_2CH_2$—* | 213 |
| | **—$CH_2CH_2CH_2$—* | 214 |
| | **—$CH_2CH_2CH_2CH_2$—* | 215 |
| | **—$CH_2CH_2CH_2CH_2CH_2$—* | 216 |
| | **—$CH_2CH_2$—($OCH_2CH_2$)n-* | |
| | n = 1 | 217 |
| | 2 | 218 |
| | 3 | 219 |

<Synthesis of Illustrated Compound No. 2>

Compound No. 2

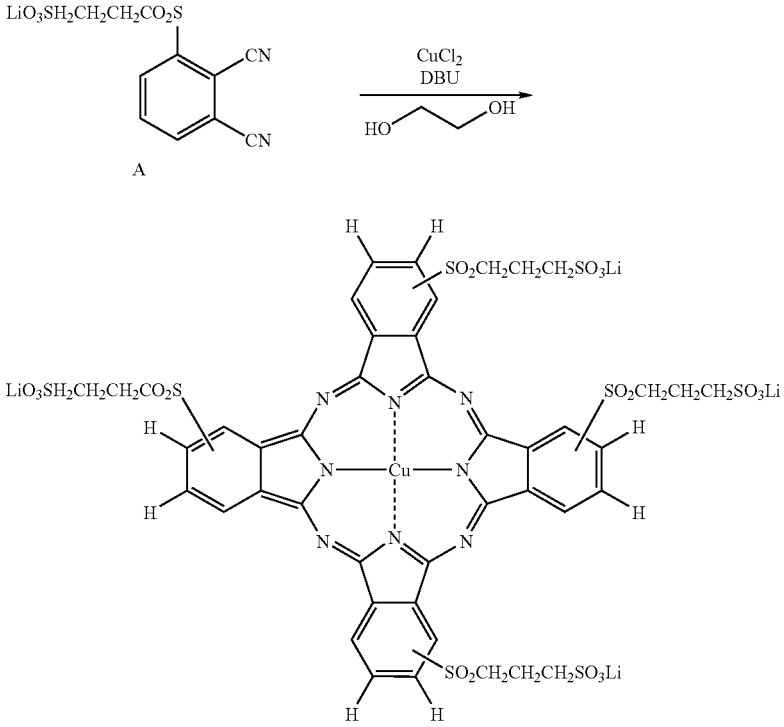

$CuCl_2$ (134 mg, 1 mmol) was added to a synthetic intermediate A (1.26 g, 4 mmol) in an ethylene glycol solution (10 mL), and this was heated to 100° C. DBU (1.52 g, 10 mmol) was added to the reaction mixture, and stirring was carried out for 10 hours at 100° C. The reaction mixture was acidified with hydrochloric acid, and lithium chloride was added thereto to separate a crude phthalocyanine. The obtained crude product was purified through column chromatography using Sephadex G-15 as a carrier. 67 mg of a mixture of illustrated compound No. 2 was obtained (yield of 5%).

<Adding Method>

The phthalocyanine compound according to the present invention is preferably water soluble and is preferably used for the manufacturing of photothermographic material as an aqueous solution prepared in advance by water as a medium. In the said solution, the water-soluble phthalocyanine compound according to the present invention is contained in an amount of from 0.1% by weight to 30% by weight, preferably from 0.5% by weight to 20% by weight, and more preferably from 1% by weight to 8% by weight. The said solution further may contain a water-soluble organic solvent or an auxiliary additive. A content of water-soluble organic solvent is from 0% by weight to 30% by weight, and preferably from 5% by weight to 30% by weight. A content of auxiliary additive is from 0% by weight to 5% by weight, and preferably from 0% by weight to 2% by weight.

At the preparation of an aqueous solution of the water-soluble phthalocyanine compound according to the present invention, as specific examples of the usable water-soluble organic solvent, alkanol having 1 to 4 carbon atoms such as methanol, ethanol, propanol, isopropanol, butanol, isobutanol, sec-butanol, tert-butanol, or the like; amide carboxylate such as N,N-dimethylformamide, N,N-dimethylacetamide, or the like; lactams such as ϵ-caprolactam, N-methylpirrolidine-2-one, or the like; urea; a cyclic urea such as 1,3-dimethylimidazolidine-2-one, 1,3-dimethylhexahydropyrimide-2-one, or the like; ketone or ketoalcohol such as acetone, methyl ethyl ketone, 2-methyl-2-hydroxypentane-4-one, or the like; ether such as tertahydrofuran, dioxan, or the like; mono-, oligo-, and polyalkylene glycol or thioglycol having an alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol, or the like; polyol (triol) such as glycerine, hexane-1,2,6-triol, or the like; alkyl ether with 1 to 4 carbon atoms of poly-alcohol such as ethylene glycol monomethyl ether, ethylene glycol monoethyl ether, diethylene glycol monomethyl ether, diethylene glycol monoethyl ether, triethylene glycol monomethyl ether, triethylene glycol monoethyl ether, or the like; γ-butylolactone, dimethylsulfoxide, and the like can be described. Two or more of these water-soluble organic solvents can be used in combination.

Among the water-soluble organic solvents described above, urea, N-methylpyrrolidine-2-one, mono, di, or trialkylene glycol having an alkylene unit with 2 to 6 carbon atoms are preferable, and mono, di, or triethylene glycol, dipropylene glycol, dimethylsulfoxide, and the like are more preferable. Particularly, N-methylpyrrolidine-2-one, diethylene glycol, dimethyl sulfoxide, or urea is preferably used, and urea is most preferable. As the water-soluble phthalocyanine dye according to the invention is diluted by mixing the said aqueous solution with various chemicals at the making of photothermographic material, the method of containing a water-soluble organic solvent, besides the said aqueous solution, in an amount of from 1 mol to 500 mol per 1 mol of the water-soluble metal phthalocyanine compound is also preferably applied.

Examples of auxiliary additives include an antiseptic, a pH control agent, a chelating agent, a rust-preventing agent, a water-soluble ultraviolet ray absorbing agent, a water-soluble polymer, a dye solvent, a surfactant, and the like, and they are added if necessary.

Examples of the antiseptic include sodium dihydroacetates, sodium sorbinates, sodium 2-pyridinethiol-1-oxides, sodium benzoates, sodium pentachloro phenols, benzisothiazolinones and salts thereof, p-hydroxybenzoic acid esters, and the like.

As the pH control agent, any compounds can be applied as long as it can control the pH of the prepared solution in a range of from 4 to 11 without any bad effect. Examples of the pH control agent include alkanolamine such as diethanolamine or triethanol amine; alkali metal salts of hydroxide such as lithium hydroxide, sodium hydroxide, or potassium hydroxide; ammonium hydroxide; and alkali metal salts of carbonic acid such as lithium carbonate, sodium carbonate, or potassium carbonate.

Examples of the chelating agent include a sodium salt of ethylenediaminetetraacetic acid, a sodium salt of nitrilotriacetic acid, a sodium salt of hydroxyethyl ethylenediaminetriacetic acid, a sodium salt of diethylene triaminepentaacetic acid, a sodium salt of uracil diacetic acid, and the like. Examples of the rust-preventing agent include hyposulfites, sodium thiosulfate, thioglycolic acid ammonium salt, diisopropyl ammonium nitrite, pentaerythrithol tetranitrate, dicyclohexylammonium nitrite, and the like. Examples of the water-soluble polymer include poly(vinyl alcohol), a cellulose derivative, polyamine, polyimine, and the like. Examples of the water-soluble ultraviolet ray absorbing agent include a sulfonated benzophenone, a sulfonated benztriazole, and the like. Examples of the dye solvent include ϵ-caprolactam, ethylene carbonate, urea, and the like. Examples of the surfactant include well-known surfactants of anionic, cationic, and nonionic surfactants, and a surfactant of acetylene glycol type or the like is also preferably used.

<Range of Addition Amount>

The water-soluble dye according to the present invention is added in an amount as such that the optical density by the dye itself is preferably from 0.1 to 0.8, and more preferably from 0.2 to 0.6 when measured at the absorption maximum wavelength of the dye. To obtain the above optical density, the addition amount of dye is generally from 10 mg/m$^2$ to 150 mg/m$^2$, and preferably from 20 mg/m$^2$ to 80 mg/m$^2$.

(Non-Photosensitive Organic Silver Salt Incorporated in Image Forming Layer)

1) Composition

The non-photosensitive organic silver salt which can be used in the present invention is relatively stable to light but serves as to supply silver ions and forms silver images when heated to 80° C. or higher in the presence of an exposed photosensitive silver halide and a reducing agent. The organic silver salt may be any organic substance which supplies silver ions that are reducible by a reducing agent. Such a non-photosensitive organic silver salt is disclosed, for example, in JP-A No. 10-62899 (paragraph Nos. 0048 to 0049), European Patent (EP) No. 803,764A1 (page 18, line 24 to page 19, line 37), EP No. 962,812A1, JP-A Nos. 11-349591, 2000-7683, and 2000-72711, and the like. A silver salt of an organic acid, particularly, a silver salt of a long-chained aliphatic carboxylic acid (having 10 to 30 carbon atoms, and preferably having 15 to 28 carbon atoms) is preferable. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably 85 mol % or higher, and even more preferably 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, rod-like, tabular, or flake shaped.

In the invention, a flake shaped organic silver salt is preferred. Short needle-like, rectangular, cubic, or potato-like indefinite shaped particles with a length ratio of major axis to minor axis being lower than 5 are also used preferably. Such organic silver salt particles suffer less from fogging during thermal development compared with long needle-like particles with the length ratio of major axis to minor axis being 5 or higher. Particularly, a particle with the length ratio of major axis to minor axis being 3 or lower is preferred since it can improve mechanical stability of the coating film. In the present specification, the flake shaped organic silver salt is defined as described below. When an organic silver salt is observed under an electron microscope, calculation is made while approximating the shape of a particle of the organic silver salt to a rectangular body and assuming each side of the rectangular body as a, b, c from the shortest side (c may be identical with b) and determining x based on numerical values a, and b for the shorter side as below.

$$x=b/a$$

As described above, x is determined for the particles in an amount of about 200 and those satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4, and most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake shaped particle is preferably from 1.1 to 30 and, more preferably, from 1.1 to 15 with a viewpoint of causing less agglomeration in the photothermographic material and improving the image storability.

As the particle size distribution of the organic silver salt, mono-dispersion is preferred. In the mono-dispersion, the percentage for the value obtained by dividing the standard deviation for the length of minor axis and major axis by the minor axis and the major axis respectively is preferably 100% or less, more preferably 80% or less and, even more preferably 50% or less. The shape of the organic silver salt can be measured by analyzing a dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient) is preferably 100% or less, more preferably 80% or less and, even more preferably 50% or less. The mono-dispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 803,763A1 and 962,812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be manufactured by mixing an aqueous dispersion of the organic silver salt and an aqueous dispersion of a photosensitive silver salt, and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably from 2 mol % to 20 mol % and, particularly preferably from 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$. In particular, in order to improve image storability, the total amount of coated silver is preferably 1.8 $mg/m^2$ or less, and more preferably 1.6 $mg/m^2$ or less. In the case where a preferable reducing agent according to the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) which reduces silver ions into metallic silver.

Examples of the reducing agent are described in JP-A No. 11-65021 (column Nos. 0043 to 0045) and EP No. 803, 764A1 (p. 7, line 34 to p. 18, line 12).

The reducing agent according to the invention is preferably a so-called hindered phenol reducing agent or a bisphenol reducing agent having a substituent at the ortho-position with respect to the phenolic hydroxy group. It is more preferably a compound represented by the following formula (R).

Formula (R)

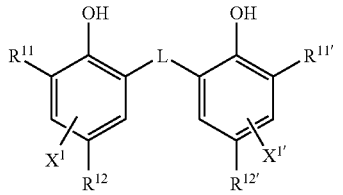

In formula (R), $R^{11}$ and $R^{11'}$ each independently represent an alkyl group having 1 to 20 carbon atoms. $R^{12}$ and $R^{12'}$ each independently represent a hydrogen atom or a substituent which substitutes for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

In the following description, when referred an alkyl group, it means that the alkyl group contains a cycloalkyl group, unless otherwise specified.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and include, preferably, an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a substituent which substitutes for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group include, similar to the substituent of $R^{11}$, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms; and examples thereof include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are even more preferred and, a methyl group and a t-butyl group being most preferred.

$R^{12}$ and $R^{12'}$ are preferably an alkyl group having 1 to 20 carbon atoms; and examples thereof include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group, and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group, a 2,4-dimethyl-3-cyclohexenyl group, and a cyclohexyl group are preferred.

The reducing agent described above shows thermal development performance, different color tone of developed silver images, or the like depending on the combination of $R^{11}$, $R^{11'}$, $R^{12}$, $R^{12'}$, and $R^{13}$. Since the performances can be controlled by using two or more reducing agents in combination, it is preferred to use two or more reducing agents in combination depending on the purpose.

Specific examples of the reducing agent according to the invention including the compounds represented by formula (R) according to the invention are shown below, but the invention is not restricted to these.

R-1
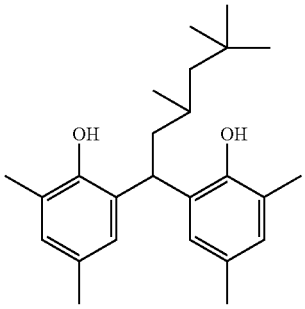
R-2
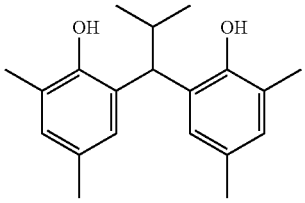
R-3
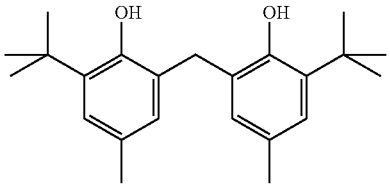
R-4
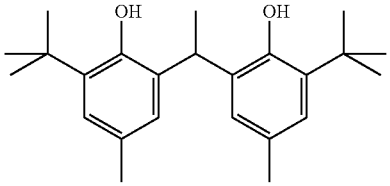
R-5
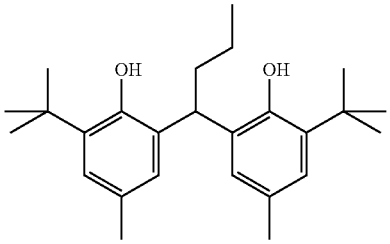
R-6
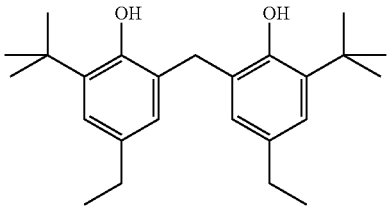
R-7
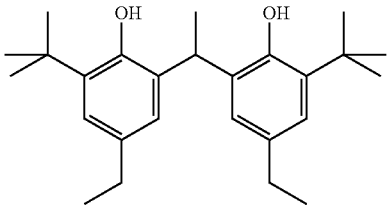
-continued
R-8
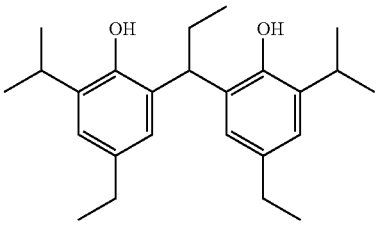
R-9
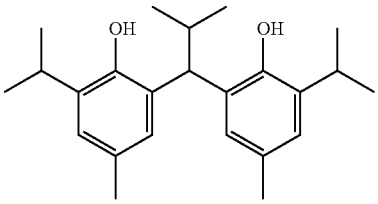
R-10
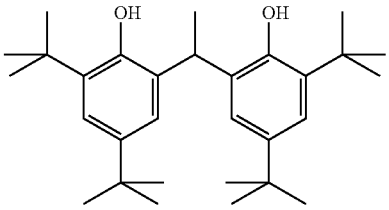
R-11
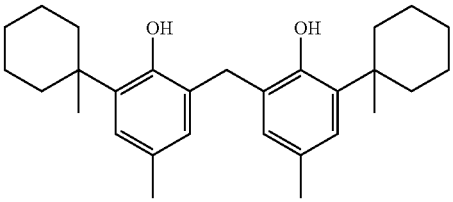
R-12
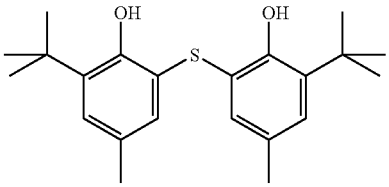
R-13
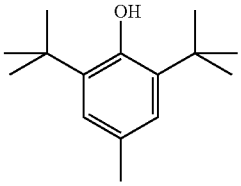
R-14
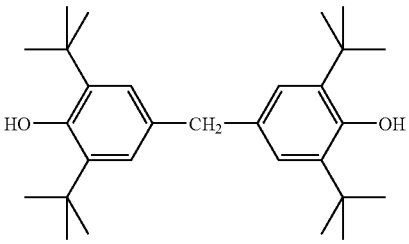

-continued

R-15

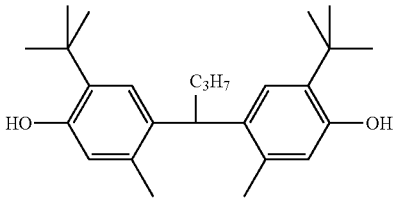

R-16

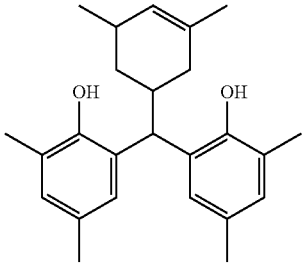

R-17

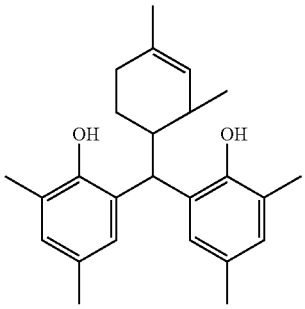

R-18

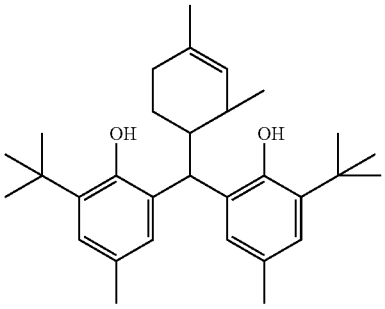

As preferred examples of the reducing agent according to the invention other than those above, there are mentioned compounds disclosed in JP-A Nos. 2001-188314, 2001-209145, 2001-350235, and 2002-156727, and EP No. 1,278,101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into the photothermographic material by being added into the coating solution, such as in the form of a solution, an emulsified dispersion, a solid fine particle dispersion, or the like.

As well known emulsion dispersing method, there is mentioned a method comprising dissolving the reducing agent in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there is mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining a solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as a solid particle dispersion, and is added in the form of fine particles having a mean particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, as a development accelerator, sulfonamido phenol compounds described in the specification of JP-A No. 2000-267222, and represented by formula (A) described in the specification of JP-A No. 2000-330234; hindered phenol compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenol or naphthol compounds represented by formula (2) described in the specification of JP-A No. 2001-264929 are used preferably. Further, phenol compounds described in JP-A Nos. 2002-311533 and 2002-341484 are also preferable. Naphthol compounds described in JP-A No. 2003-66558 are particularly preferable. The development accelerator is used in a range of from 0.1 mol % to 20 mol %, preferably in a range of from 0.5 mol % to 10 mol % and, more preferably in a range of from 1 mol % to 5 mol %, with respect to the reducing agent. The introducing methods to the photothermographic material include similar methods as those for the reducing agent and, it is particularly preferred to add as a solid dispersion or an emulsified dispersion. In the case of adding as an emulsified dispersion, it is preferred to add as an emulsified dispersion dispersed by using a solvent having a high boiling point which is solid at a normal temperature and an auxiliary solvent having a low boiling point, or to add as a so-called oilless emulsified dispersion not using a solvent having a high boiling point.

In the present invention, among the development accelerators described above, it is more preferred to use hydrazine compounds described in the specification of JP-A Nos. 2002-156727 and 2002-278017, and naphthol compounds described in the specification of JP-A No. 2003-66558.

Particularly preferred development accelerators according to the invention are compounds represented by the following formulae (A-1) or (A-2).

$Q_1$-NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and the like. Condensed rings in which the rings described above are condensed to each other are also preferred.

The rings described above may have substituents and in the case where they have two or more substituents, the substituents may be identical or different from each other. Examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms, and more preferably having 6 to 40 carbon atoms; and examples thereof include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group preferably having 1 to 50 carbon atoms, and more preferably having 6 to 40 carbon atoms; and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group preferably having 2 to 50 carbon atoms, and more preferably having 6 to 40 carbon atoms; and examples thereof include methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms, and more preferably having 7 to 40 carbon atoms; and examples thereof include phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms, and more preferably having 6 to 40 carbon atoms; and examples thereof include methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group preferably having 0 to 50 carbon atoms, and more preferably having 6 to 40 carbon atoms; and examples thereof include unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isoxazole ring, and a ring in which the ring described above is condensed with a benzene ring or unsaturated heterocycle are more preferred. Further, $Q_2$ is preferably a carbamoyl group and, particularly, a carbamoyl group having a hydrogen atom on the nitrogen atom is particularly preferred.

Formula (A-2)

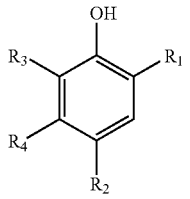

In formula (A-2), $R_1$ represents one selected from an alkyl group, an acyl group, an acylamino group, a sulfonamido group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphthol compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator according to the invention are to be described below. The invention is not restricted to them.

A-1

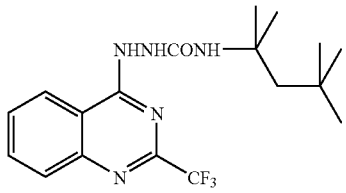

A-2

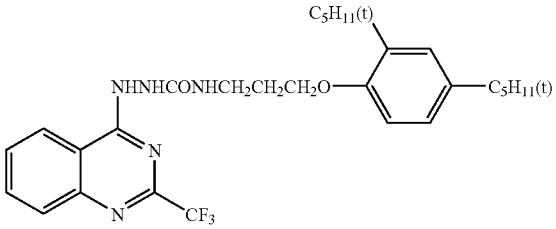

A-3

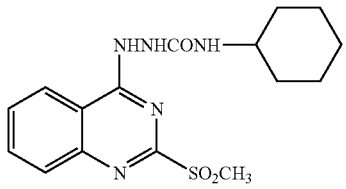

-continued

A-4

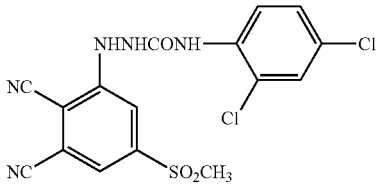

A-5

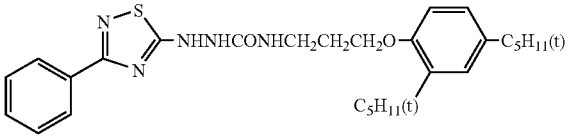

A-6

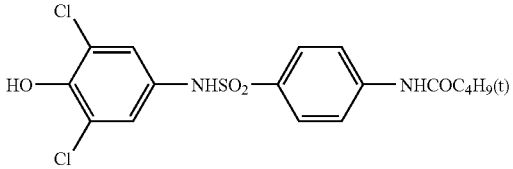

A-7

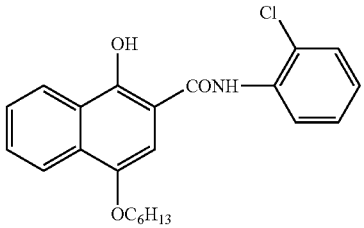

A-8

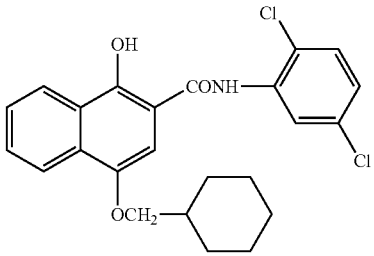

A-9

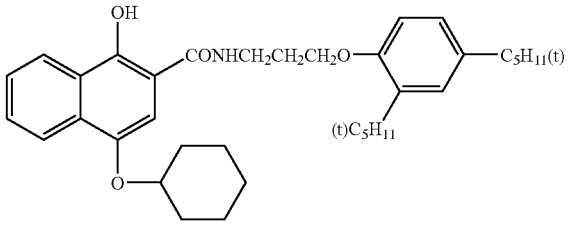

A-10

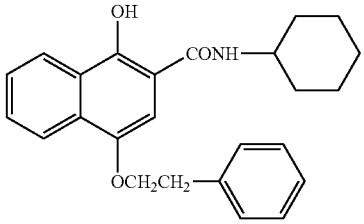

-continued

A-11

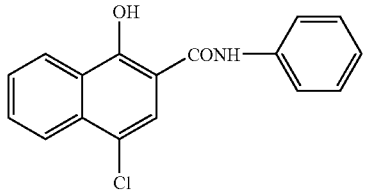

A-12

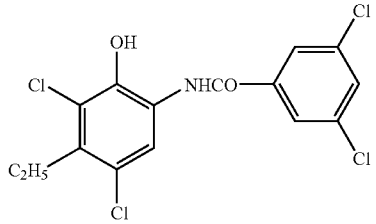

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which reacts with these groups of the reducing agent and forms a hydrogen bond therewith.

As the group forming a hydrogen bond with a hydroxy group or an amino group, there are mentioned a phosphoryl group, a sulfoxide group, a sulfonyl group, a carbonyl group, an amido group, an ester group, a urethane group, a ureido group, a tertiary amino group, a nitrogen-containing aromatic group, and the like. Particularly preferred among them is a phosphoryl group, a sulfoxide group, an amido group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound represented by formula (D) shown below.

Formula (D)

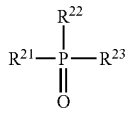

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, a 2-phenoxypropyl group, and the like.

As the aryl group, there are mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As the alkoxy group, there are mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As the aryloxy group, there are mentioned a phenoxy group, a cresyloxy group, an isopropylphenoxy group, a 4-t-butylphenoxy group, a naphthoxy group, a biphenyloxy group, and the like.

As the amino group, there are mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) according to the invention and others according to the invention are shown below, but the invention is not limited thereto.

D-1

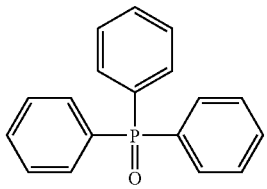

D-2

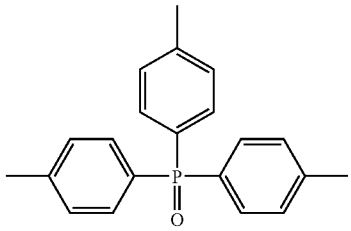

D-3

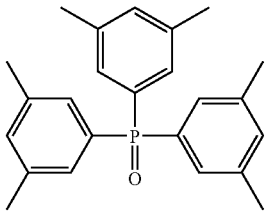

-continued

D-4

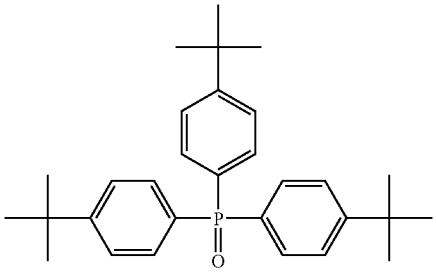

D-5

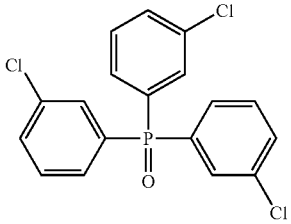

D-6

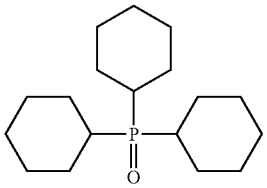

D-7

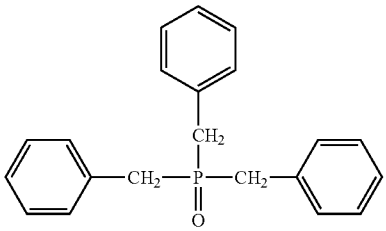

D-8

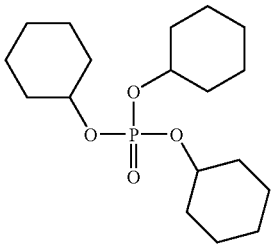

D-9

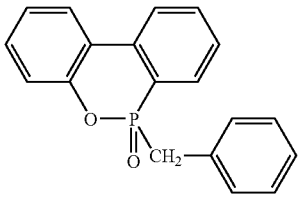

D-10

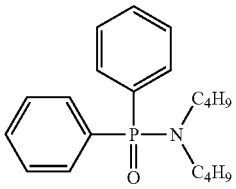

-continued

D-11

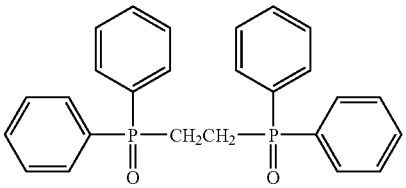

D-12

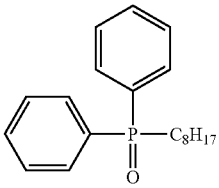

D-13

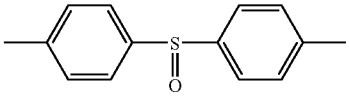

D-14

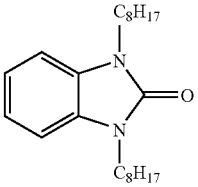

D-15

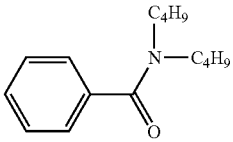

Specific examples of hydrogen bonding compounds other than those enumerated above can be found in those described in EP No. 1,096,310 and in JP-A Nos. 2002-156727 and 2002-318431.

The compound represented by formula (D) according to the invention can be used in the photothermographic material by being incorporated into the coating solution in the form of a solution, an emulsified dispersion, or a solid fine particle dispersion, similar to the case of reducing agent. However, it is preferably used in the form of a solid dispersion. In the solution, the compound represented by formula (D) forms a hydrogen-bonded complex with a compound having a phenolic hydroxy group or an amino group, and can be isolated as a complex in crystalline state depending on the combination of the reducing agent and the compound represented by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powder and dispersing them with a proper dispersing agent using sand grinder mill or the like.

The compound represented by formula (D) is preferably used in a range of from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition, and silver chloride, silver bromochloride, silver bromide, silver iodobromide, silver iodochlorobromide, or silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably in a range of from 0.01 μm to 0.15 μm and, even more preferably from 0.02 μm to 0.12 μm. The grain size as used herein means a diameter of a circle converted such that it has a same area as a projected area of the silver halide grain (projected area of a major plane in a case of a tabular grain).

4) Grain Shape

The shape of the silver halide grain includes, for example, cubic, octahedral, tabular, spherical, rod-like, or potato-like shape. A cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably 65% or higher and, even more preferably 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain according to the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used in combination. A preferred content is in a range of from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, counter cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just prior to completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and, it becomes possible to prepare fine silver halide grains with smaller grain size.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various types of gelatins can be used. It is necessary to maintain an excellent dispersion state of a photosensitive silver halide emulsion in the coating solution containing an organic silver salt, and gelatin having a molecular weight of 10,000 to 1,000,000 is preferably used.

Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those which spectrally sensitizes the silver halide grains in a desired wavelength region upon adsorption to the silver halide grains having spectral sensitivity suitable to the spectral characteristic of an exposure light source can be advantageously selected. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone or two or more of them may be used in combination. In the invention, the sensitizing dye is preferably added in the silver halide emulsion after a desalting step and before coating, and more preferably after a desalting step and before completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain according to the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formula (II), (III), or (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just prior to coating, or the like.

The amount of sulfur, selenium, or tellurium sensitizer used in the invention may vary depending on the silver halide grain used, the chemical ripening condition, and the like, and it is used in an amount of from $10^{-8}$ mol to $10^{-2}$ mol, and preferably from $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain according to the invention. As the specific compound for the reduction sensitization, ascorbic acid or aminoimino methane sulfinic acid is preferred, as well as use of stannous chloride, a hydrazine derivative, a borane compound, a silane compound, a polyamine compound, or the like is preferred. The reduction sensitizer may be added at any stage in the photosensitive emulsion producing process from crystal growth to the preparation step just prior to coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound That is One-Electron-Oxidized to Provide a One-Electron Oxidation Product Which Releases One or More Electrons The photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons, which is contained in the photothermographic material of the invention, is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786,692A1 (Compound INV 1 to 35); EP No. 893,732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). Preferable ranges of these compounds are the same as the preferable ranges described in the quoted specifications.

Formula (1)

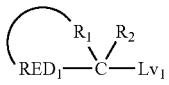

Formula (2)

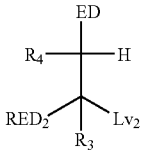

In formulae (1) and (2), $RED_1$ and $RED_2$ each independently represent a reducing group. $R_1$ represents a nonmetallic atomic group forming a cyclic structure equivalent to a tetrahydro derivative or a hexahydro derivative of a 5- or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

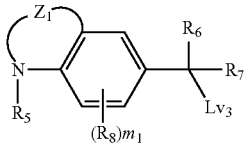

Formula (4)

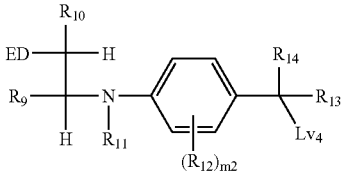

-continued

Formula (5)

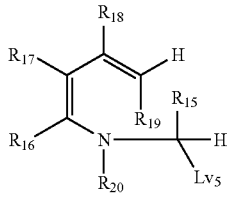

In formulae (3), (4), and (5), $Z_1$ represents an atomic group forming a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent; however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent which substitutes for a hydrogen atom on a benzene ring. $m_1$ represents an integer of from 0 to 3, and m2 represents an integer of from 0 to 4. $Lv_3$, $Lv_4$, and $Lv_5$ each independently represent a leaving group.

Formula (6)

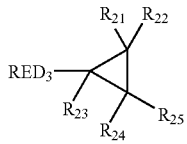

Formula (7)

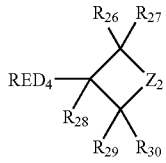

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

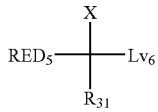

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

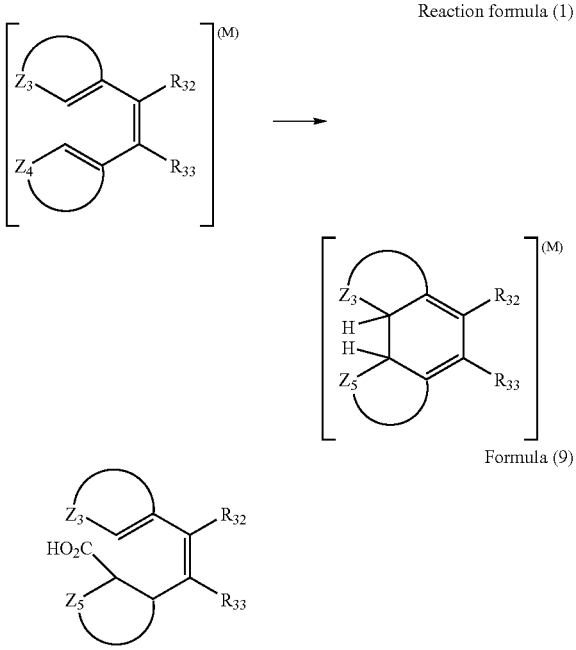

Formula (9)

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. M represents one selected from a radical, a radical cation, or a cation. In formula (9), $R_{32}$, $R_{33}$, and $Z_3$ each have the same meaning as in reaction formula (1). $Z_5$ represents a group which forms a 5- or 6-membered cyclic aliphatic hydrocarbon group or heterocyclic group with C—C.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which is one-electron-oxidized. Y represents a reactive group containing a carbon-carbon double bond part, a carbon-carbon triple bond part, an aromatic group part, or benzo-condensed nonaromatic heterocyclic part which reacts with one-electron-oxidized product formed by one-electron-oxidation of $RED_6$ to form a new bond. Q represents a linking group which links $RED_6$ and Y.

Reaction formula (1)

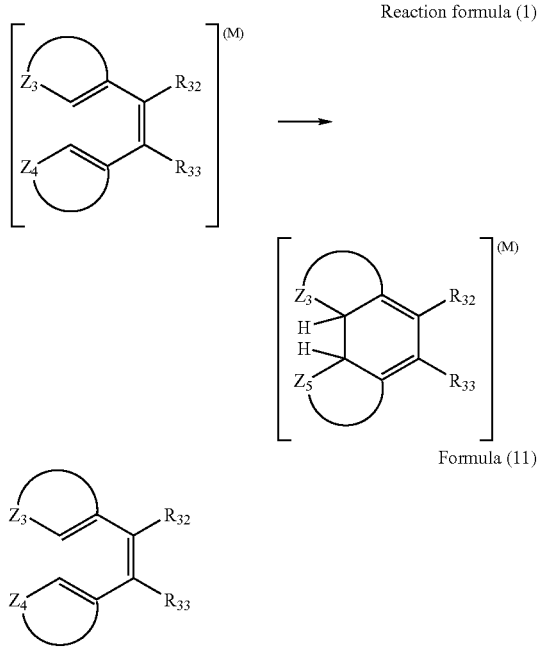

Formula (11)

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. $Z_5$ represents a group which forms a 5- or 6-membered cyclic aliphatic hydrocarbon group or heterocyclic group with C—C. M represents one selected from a radical, a radical cation, or a cation. In formula (11), $R_{32}$, $R_{33}$, $Z_3$, and $Z_4$ each have the same meaning as in reaction formula (1).

The compounds of Groups 1 or 2 are preferably "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1, 2,4-triazole group and a benzotriazole group are particularly preferable, and a 3-mercapto-1,2,4-triazole group and a 5-mercaptotetrazole group are most preferable.

As the adsorptive group, the group which has two or more mercapto groups as a partial structure in a molecule is also particularly preferable. Herein, the mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as the adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom are described. As typical quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyridinio group, a quinolinio group and an isoquinolinio group are used. These nitrogen-containing heterocyclic groups containing a quaternary nitrogen atom may have any substituent.

Examples of counter anions of quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter anion outside of a molecule, chloro ion, bromo ion, and methanesulfonate ion are particularly preferable.

The preferred structure of the compound represented by Groups 1 or 2 having a quaternary salt of nitrogen or phosphorus as the adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(=O)—, —$SO_2$—, —SO—, —P(=O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with the non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer at the coating step. The compound may be added before or after addition of a sensitizing dye. The compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably contains a compound having an adsorptive group to silver halide and a reducing group in a molecule. It is preferred that the compound is represented by the following formula (I).

$$A\text{-}(W)n\text{-}B \qquad \text{Formula (I)}$$

In formula (I), A represents a group which adsorbs to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(=S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion, or the like.

Further, the mercapto group as the adsorptive group may become a thione group by a tautomerization.

The thione group used as the adsorptive group also includes a linear or cyclic thioamido group, thioureido group, thiourethane group, and dithiocarbamate ester group.

The heterocyclic group, as the adsorptive group, which contains at least one atom selected from a nitrogen atom, a sulfur atom, a selenium atom, or a tellurium atom represents a nitrogen-containing heterocyclic group having —NH— group, which forms silver iminate (—N(Ag)—), as a partial structure of a heterocycle, or a heterocyclic group having an —S— group, a —Se— group, a —Te— group, or a =N— group, which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as the adsorptive group means —C≡CH group and the said hydrogen atom may be substituted.

The adsorptive group described above may have any substituent.

Further, as typical examples of the adsorptive group, the compounds described in pages 4 to 7 in the specification of JP-A No. 11-95355 are described.

As the adsorptive group represented by A in formula (I), a heterocyclic group substituted by a mercapto group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group which forms silver iminate (—N(Ag)—)as a partial structure of heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (I), W represents a divalent linking group. The said linking group may be any divalent linking group, as long as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), the reducing group represented by B represents a group which reduces a silver ion. As examples thereof, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like are described. They may have any substituent.

The oxidation potential of the reducing group represented by B in formula (I) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When the reducing group represented by B in the present invention is measured by the method described above, an oxidation potential is preferably in a range of from about −0.3 V to about 1.0 V, more preferably in a range of from about −0.1 V to about 0.8 V, and particularly preferably in a range of from about 0 V to about 0.7 V.

In formula (I), the reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have a ballast group or polymer chain, which are generally used in the non-moving photographic additives of a coupler or the like, in it. And as a polymer, for example, the polymer described in JP-A No. 1-100530 is selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

Specific examples of the compound represented by formula (I) according to the present invention are shown below, but the present invention is not limited in these.

(1)
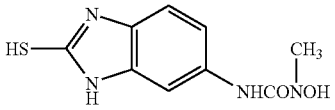
(2)
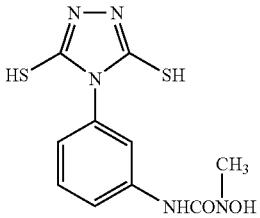
(3)
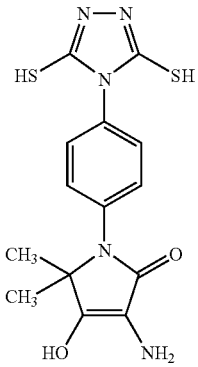
(4)
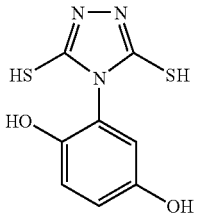
(5)
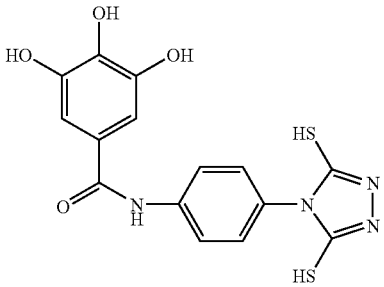
(6)
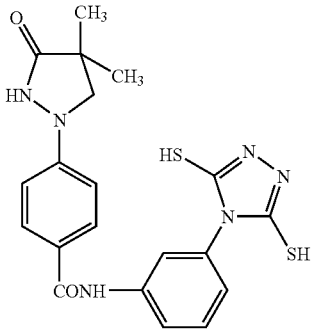
-continued
(7)
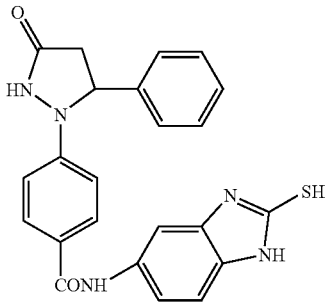
(8)
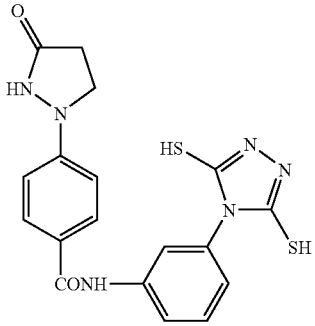
(9)
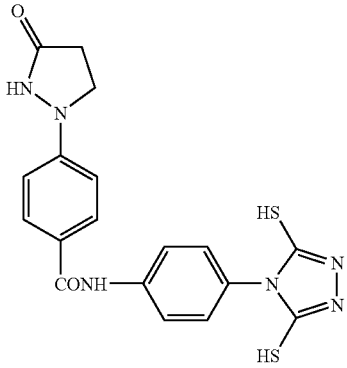
(10)
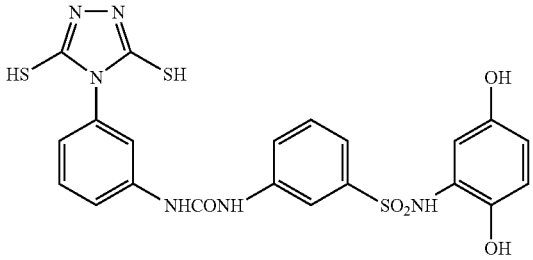
(11)
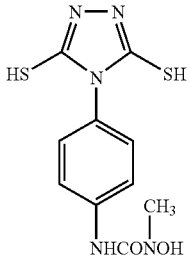

-continued (12)

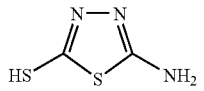

(13)

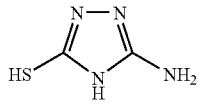

Further, example compounds 1 to 30 and 1"-1 to 1"-77 shown in EP No. 1,308,776A2, pages 73 to 87 are also described as preferable examples of the compound having an adsorptive group and a reducing group according to the invention.

These compounds can be easily synthesized by any known method. The compound of formula (I) according to the present invention may be used alone, but it is preferred to use two or more of the compounds in combination. When two or more of the compounds are used in combination, those may be added to the same layer or the different layers, whereby adding methods may be different from each other.

The compound represented by formula (I) according to the present invention is preferably added to the image forming layer and more preferably, is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer at the coating step.

The preferred addition amount is largely dependent on the adding method described above or the type of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving it in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of Silver Halides

The photosensitive silver halide emulsion in the photothermographic material used in the invention may be used alone, or two or more of them (for example, those having different mean grain sizes, different halogen compositions, different crystal habits, or different conditions for chemical sensitization) may be used together. Gradation can be controlled by using plural photosensitive silver halides having different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably from 0.05 $g/m^2$ to 0.4 $g/m^2$ and, most preferably from 0.07 $g/m^2$ to 0.3 $g/m^2$. The photosensitive silver halide is used in a range of from 0.01 mol to 0.5 mol, preferably from 0.02 mol to 0.3 mol, and even more preferably from 0.03 mol to 0.2 mol, per 1 mol of the organic silver salt.

13) Mixing Silver Halide and Organic Silver Salt

The method of mixing separately prepared the photosensitive silver halide and the organic silver salt include a method of mixing prepared photosensitive silver halide grains and organic silver salt by a high speed stirrer, ball mill, sand mill, colloid mill, vibration mill, homogenizer, or the like, and a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling photographic properties.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Binder)

Any polymer having a film-forming property may be used as the binder for the image forming layer according to the invention. Suitable as the binder are those that are transparent or translucent, and that are generally colorless, such as natural resin or polymer and their copolymers; synthetic resin or polymer and their copolymer; or media forming a film; for example, included are rubbers, cellulose acetates, cellulose acetate butyrates, poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides.

Particularly preferably, the binder in the image forming layer according to the invention is a hydrophobic polymer latex.

In the present invention, the glass transition temperature (Tg) of the binder for the image forming layer is preferably in a range of from 0° C. to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer components (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

<<Solubility Parameter>>

The solubility parameter of the binder used in the present invention is preferably in a range of from 7 $(cal/cm^3)^{1/2}$ to 15 $(cal/cm^3)^{1/2}$, more preferably from 7.5 $(cal/cm^3)^{1/2}$ to 13 $(cal/cm^3)^{1/2}$, and most preferably from 8 $(cal/cm^3)^{1/2}$ to 12 $(cal/cm^3)^{1/2}$.

Calculation of solubility parameter (SP value) is based on the method described in VII 680 to 683 of Polymer Handbook 4th edition, published by John Wiley & Sons. Solubility parameter (SP value) is a value commonly used as a factor indicating a polarity per unit volume that is expressed by cohesive energy density, namely ½ power of evaporation energy per unit volume of one molecule.

In the case of polymer, the solubility parameter is generally calculated using the following Small's equation.

$$SP=d\Sigma G/M$$

M: Unit molecular weight of polymer d: Density

G: A constant inherent to the atomic group or group

Solubility parameters of conventional polymer are described in VII 702 to 711 of Polymer Handbook, 4th edition, published by John Wiley & Sons.

In the present invention, the value obtained by substituting Hoy's cohesive energy constant to the Small's equation mentioned above was used as the solubility parameter of the polymer.

The binder may be of two or more polymers depending on needs. And, the polymer having Tg of 20° C. or higher and the polymer having Tg of lower than 20° C. can be used in combination. In the case where two or more polymers differing in Tg may be blended for use, it is preferred that the weight-average Tg is within the range mentioned above.

In the invention, the image forming layer is preferably formed by applying a coating solution using an aqueous solvent which contains 30% by weight or more of water in the solvent and by then drying.

The aqueous solvent signifies water or water containing mixed therein 70% by weight or less of a water-miscible organic solvent. As the water-miscible organic solvent, there are described, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, or the like.

The equilibrium water content at 25° C. and 60% RH is preferably 2% by weight or lower, and is more preferably, in a range of from 0.01% by weight to 1.5% by weight, and is even more preferably, from 0.02% by weight to 1% by weight.

As the hydrophobic polymer, hydrophobic polymer such as acrylic polymer, polyesters, rubbers (e.g., SBR resin), polyurethanes, poly(vinyl chlorides), poly(vinyl acetates), poly(vinylidene chlorides), polyolefins, or the like can be used preferably. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

Preferably, 50% by weight or more of the binder is occupied by polymer latex having a monomer component represented by the following formula (M).

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, a substituted or unsubstituted alkyl group having 1 to 6 carbon atoms, a halogen atom, or a cyano group. More preferably, both of $R^{01}$ and $R^{02}$ represent a hydrogen atom, or one of $R^{01}$ or $R^{02}$ represents a hydrogen atom and the other represents a methyl group.

Preferably, the polymer latex contains the monomer component represented by formula (M) within a range of from 10% by weight to 70% by weight, and more preferably from 20% by weight to 60% by weight.

<Specific Examples of Latex>

Specific examples of preferred polymer latex are given below, which are expressed by the starting monomers with % by weight given in parenthesis. The molecular weight is given in number average molecular weight. In the case where polyfunctional monomer is used, the concept of molecular weight is not applicable because they build a crosslinked structure. Hence, they are denoted as "crosslinking", and the description of the molecular weight is omitted. Tg represents glass transition temperature.

P-1: Latex of -MMA(55)-EA(42)-MAA(3)—(molecular weight 39,000, Tg: 39° C., SP value 9.60)

P-2: Latex of -MMA(60)-2EHA(30)-St(5)-AA(5)—(molecular weight 42,000, Tg 40° C., SP value 9.39)

P-3: Latex of—St(62)-Bu(35)-MAA(3)—(crosslinking, Tg 5° C., SP value 9.35)

P-4: Latex of—St(68)-Bu(29)-AA(3)—(crosslinking, Tg 17° C., SP value 9.38)

P-5: Latex of—St(71)-Bu(26)-AA(3)—(crosslinking, Tg 24° C., SP value 9.39)

P-6: latex of—St(70)-Bu(27)-IA(3)—(crosslinking, Tg 23° C., SP value 9.41)

P-7: Latex of—St(75)-Bu(24)-AA(1)—(crosslinking, Tg 29° C., SP value 9.39)

P-8: Latex of—St(60)-Bu(35)-DVB(3)-MAA(2)—(crosslinking, Tg 6° C., SP value 9.37)

P-9: Latex of—St(70)-Bu(25)-DVB(2)-AA(3)—(crosslinking, Tg 26° C., SP value 9.41)

P-10: Latex of -VC(35)-MMA(20)-EA(35)-AN(5)-AA(5)—(molecular weight 75,000, Tg 41° C., SP value 9.92)

P-11: Latex of -VDC(65)-MMA(25)-EA(5)-MAA(5)—(molecular weight 67,000, Tg 12° C., SP value 10.04)

P-12: Latex of -EA(60)-MMA(30)-MAA(10)—(molecular weight 12,000, Tg 16° C., SP value 9.65)

P-13: Latex of—St(70)-2EHA(27)-AA(3)—(molecular weight 130,000, Tg 43° C., SP value 9.38)

P-14: Latex of -MMA(40)-EA(58)-AA(2)—(molecular weight 43,000, Tg 18° C., SP value 9.67)

P-15: Latex of—St(70.5)-Bu(26.5)-AA(3)—(crosslinking, Tg 23° C., SP value 9.39)

P-16: Latex of—St(69.5)-Bu(27.5)-AA(3)—(crosslinking, Tg 20.5° C., SP value 9.38)

P-17: Latex of—St(61.3)-Isoprene(35.5)-AA(3)—(crosslinking, Tg 17° C., SP value 9.04)

P-18: Latex of—St(67)-Isoprene(28)-Bu(2)-AA(3)—(crosslinking, Tg 27° C., SP value 9.13)

P-19: Latex of—St(50)-Isoprene (45)-AA(5)—(crosslinking, Tg 1° C., SP value 8.96)

P-20: Latex of—St(40)-Isoprene(57)-AA(3)—(crosslinking, Tg −17° C., SP value 8.83)

P-21: Latex of—St(30)-Isoprene(67)-AA(3)—(crosslinking, Tg −30° C., SP value 8.73)

P-22: Latex of—St(70)-Isoprene(27)-AA(3)—(crosslinking, Tg 34° C., SP value 9.15)

P-23: Latex of—St(75)-Isoprene(22)-AA(3)—(crosslinking, Tg 44° C., SP value 9.20)

P-24: Latex of—St(61.3)-2,3-Dimethyl-butadiene(35.5)-AA(3)—(crosslinking, Tg 17° C., SP value 9.04)

P-25: Latex of—St(61.3)-2-Chloro-butadiene(35.5)-AA(3)—(crosslinking, Tg 17° C., SP value 9.04)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable Latex>

Particularly preferable as the polymer latex for use in the invention is that of styrene-butadiene copolymer or that of styrene-isoprene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer. Further, the polymer latex according to the invention preferably contains acrylic acid or methacrylic acid in a range from 1% by weight to 6% by weight with respect to the sum of styrene and butadiene, and more preferably from 2% by weight to 5% by weight. The polymer latex according to the invention preferably contains acrylic acid. Preferable range of monomer content is similar to that described above. Further, the ratio of copolymerization and the like in the styrene-isoprene copolymer are similar to those in the styrene-butadiene copolymer.

As the latex of styrene-butadiene copolymer preferably used in the invention, there are mentioned P-3 to P-9, P-15, and P-16 described above, and commercially available LACSTAR-3307B, 7132C, Nipol Lx416, and the like. And as examples of the latex of styrene-isoprene copolymer, there are mentioned P-17 to P-23 described above.

In the image forming layer of the photothermographic material according to the invention, if necessary, there may be added hydrophilic polymers such as gelatin, poly(vinyl alcohol), methyl cellulose, hydroxypropyl cellulose, carboxymethyl cellulose, or the like. The hydrophilic polymer is preferably added in an amount of 30% by weight or less, and more preferably 20% by weight or less, with respect to the total weight of the binder incorporated in the image forming layer.

According to the invention, the layer containing organic silver salt (image forming layer) is preferably formed by using polymer latex for the binder. Concerning the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The layer containing organic silver salt is, in general, a photosensitive layer (image forming layer) containing a photosensitive silver halide, i.e., the photosensitive silver salt; in such a case, the mass ratio of total binder to silver halide (total binder/silver halide) is in a range of from to 400, and more preferably from 10 to 200.

The total amount of binder in the image forming layer according to the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. Concerning the image forming layer according to the invention, there may be added a crosslinking agent for crosslinking, a surfactant to improve coating ability, or the like.

(Preferred Solvent of Coating Solution)

In the invention, a solvent of a coating solution for the image forming layer of the photothermographic material (wherein a solvent and disperse medium are collectively represented as a solvent for simplicity) is preferably an aqueous solvent containing water at 30% by weight or more. Examples of components other than water may include any of water-miscible organic solvents such as methyl alcohol, ethyl alcohol, isopropyl alcohol, methyl cellosolve, ethyl cellosolve, dimethylformamide and ethyl acetate. A water content in a solvent of a coating solution is more preferably 50% by weight or higher, and even more preferably 70% by weight or higher. Examples of a preferable solvent composition include, in addition to water, water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, and the like (wherein the numerals presented above are values in % by weight).

(Antifoggant)

As an antifoggant, stabilizer and stabilizer precursor usable in the invention, there are mentioned those disclosed as patents in paragraph number 0070 of JP-A No. 10-62899 and in line 57 of page 20 to line 7 of page 21 of EP-A No.

803,764A1, the compounds described in JP-A Nos. 9-281637 and 9-329864, U.S. Pat. No. 6,083,681, and EP-A No. 1,048,975.

1) Organic Polyhalogen Compound

Preferable organic polyhalogen compound that can be used in the invention is explained specifically below. In the invention, preferred organic polyhalogen compound is the compound represented by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include a halogen atom, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group, and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinio group, or the like), a polyethyleneoxy group, a hydroxy group, or the like is also preferable.

Specific examples of the compound represented by formula (H) according to the invention are shown below.

H-1

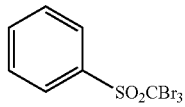

H-2

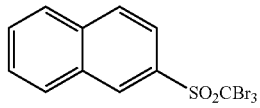

H-3

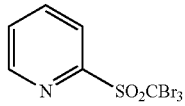

H-4

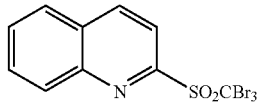

H-5

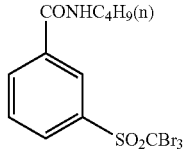

H-6

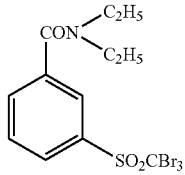

H-7

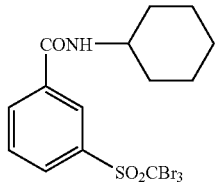

H-8

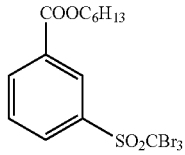

H-9

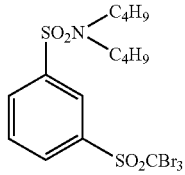

H-10

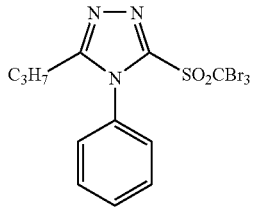

-continued

H-11

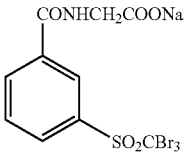

H-12

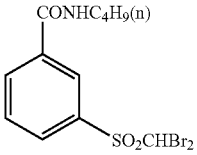

H-13

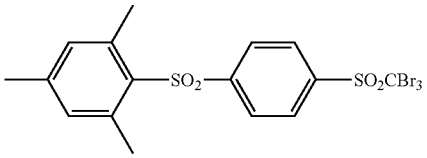

H-14

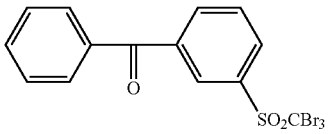

H-15

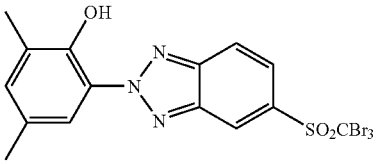

H-16

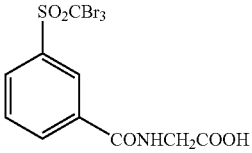

H-17

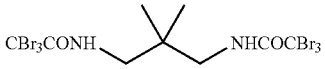

H-18

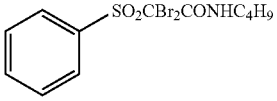

H-19

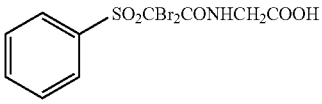

As preferred organic polyhalogen compounds which can be used in the present invention other than those above, there are mentioned compounds disclosed in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 2001-312027 are preferable.

The compound represented by formula (H) according to the invention is preferably used in an amount of from $10^{-4}$ mol to 1 mol, more preferably from $10^{-3}$ mol to 0.5 mol and, even more preferably from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there are mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to claim 9 of JP-A No. 11-352624, a compound represented by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound represented by formula (XI) described in JP-A No. 59-193447, a compound described in Japanese Patent Application Publication (JP-B) No. 55-12581, and a compound represented by formula (II) in JP-A No. 60-153039. The azolium salt may be added to any part of the photothermographic material, but as the layer to be added, it is preferred to select a layer on the side having the image forming layer, and it is more preferred to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but it is preferred to add the azolium salt after preparing the organic silver salt and just before coating. As the method for adding the azolium salt, any method using powder, a solution, a fine particle dispersion, or the like may be used. Furthermore, it may be added as a solution having mixed therein other additives such as sensitizing agents, reducing agents, toners, and the like. In the invention, the azolium salt may be added in any amount, but preferably, it is added in a range of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storability before development and storability after development. Descriptions can be found in paragraph numbers 0067 to 0069 of JP-A No. 10-62899, a compound represented by formula (I) of JP-A No. 10-186572 and specific examples thereof shown in paragraph numbers 0033 to 0052, in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, addition of a toner is preferred. Description on the toner can be found in JP-A No. 10-62899 (paragraph numbers 0054 to 0055), EP No. 803,764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point and an ester of a fatty acid having a branched structure and a molecular weight of 1000 or more.

Concerning plasticizers and lubricants usable in the image forming layer and non-photosensitive layer, compounds described in paragraph No. 0117 of JP-A No. 11-65021 and in JP-A Nos. 2000-5137, 2004-219794, 2004-219802, and 2004-334077 are preferable.

4) Nucleator

Concerning the photothermographic material of the invention, it is preferred to add a nucleator into the image forming layer. Details on the nucleators, method for their addition, and addition amount can be found in paragraph No. 0118 of JP-A No. 11-65021, paragraph Nos. 0136 to 0193 of JP-A No. 11-223898, as compounds represented by formulae (H), (1) to (3), (A), or (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but an amount of from 0.1 $mg/m^2$ to 500 $mg/m^2$ is preferred, and an amount of from 0.5 $mg/m^2$ to 100 $mg/m^2$ is more preferred.

5) Film Surface pH

The film surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred film surface pH range is from 4 to 6.2. From the viewpoint of reducing the film surface pH, it is preferred to use an organic acid such as phthalic acid derivative or a non-volatile acid such as sulfuric acid, or a volatile base such as ammonia for the adjustment of the film surface pH. In particular, ammonia can be used favorably for the achievement of low film surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring film surface pH value is described in paragraph No. 0123 of the specification of JP-A No. 2000-284399.

6) Hardener

A hardener may be used in each of image forming layer, protective layer, back layer, and the like according to the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

7) Matting Agent

In the present invention, a matting agent is preferably added to at least one layer on the backside in order to improve transportability. Description on the matting agent can be found in paragraphs Nos. 0126 to 0127 of JP-A No. 11-65021. The addition amount of the matting agent is preferably in a range of from 1 $mg/m^2$ to 400 $mg/m^2$, and more preferably from 5 $mg/m^2$ to 300 $mg/m^2$, when expressed in terms of a coating amount per 1 $m^2$ of the photothermographic material.

The shape of the matting agent usable in the invention may be a fixed form or non-fixed form. Preferred is to use those having a fixed form and a spherical shape.

Volume weighted mean equivalent spherical diameter of the matting agent used in the back surface is preferably in a range of from 1 μm to 15 μm, and more preferably from 3 μm to 10 μm. Further, the particle distribution of the matting agent is preferably set as such that the variation coefficient becomes from 3% to 50%, and more preferably from 5% to 30%. Furthermore, two or more types of matting agents having different mean particle size can be used in the back surface. In this case, the difference in particle size between the matting agent having the biggest mean particle size and the matting agent having the smallest mean particle size is preferably from 2 μm to 14 μm, and more preferably from 2 μm to 9 μm.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more when expressed by a Beck's smoothness.

In the present invention, a matting agent is preferably contained in an outermost layer, in a layer which functions as an outermost layer, or in a layer nearer to outer surface, and is also preferably contained in a layer which functions as a so-called protective layer.

8) Surfactant

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and paragraph numbers 0049 to 0062 of JP-A No. 2001-83679.

In the invention, it is preferred to use a fluorocarbon surfactant. Specific examples of the fluorocarbon surfactant can be found in those described in JP-A Nos. 10-197985, 2000-19680, and 2000-214554. Polymer fluorocarbon surfactants described in JP-A No. 9-281636 can be also used preferably. For the photothermographic material of the invention, the fluorocarbon surfactants described in JP-A Nos. 2002-82411, 2003-57780, and 2003-149766 are preferably used. Especially, the usage of the fluorocarbon surfactants described in JP-A Nos. 2003-57780 and 2001-264110 in an aqueous coating solution is preferred viewed from the standpoints of capacity in static control, stability of the coated surface state, and sliding capability. The fluorocarbon surfactant described in JP-A No. 2001-264110 is most preferred because of high capacity in static control and that it needs small amount to use.

According to the invention, the fluorocarbon surfactant can be used on either side of the image forming layer side or backside, but it is preferred to use the fluorocarbon surfactant on both sides. Further, it is particularly preferred to use it in combination with electrically conductive layer including metal oxides described below. In this case, a sufficient performance is obtained even if the amount of the fluorocarbon surfactant on the side having the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is effective, and used preferably in a range of from 0.01 mg/m$^2$ to 10 mg/m$^2$, and more preferably, in a range of from 0.1 mg/m$^2$ to 5 mg/m$^2$.

9) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen elements, or the like; $TiO_2$ with Nb, Ta, or the like. Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides includes, for example, spherical, needle-like, or tabular. The needle-like particles, in which a ratio of (the major axis)/(the minor axis) is 2.0 or higher, and more preferably from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$. The antistatic layer may be laid on either side of the image forming layer side or the backside, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower, when coating for image forming layer or back layer is conducted on the support.

11) Other Additives

Furthermore, an anti-oxidizing agent, a stabilizing agent, a plasticizer, a UV absorbent, or a film-forming promoting agent may be added to the photothermographic material of the invention. Each of the additives is added to the image forming layer or either of the non-photosensitive layers. Reference can be made to WO No. 98/36322, EP No. 803,764A1, JP-A Nos. 10-186567 and 10-18568, and the like.

12) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating. Example of the shape of the slide coater for use in slide coating is shown in FIG. 11*b*. 1, page 427, of the same literature. If desired, two or more layers can be coated simultaneously by the method described in pages 399 to 536 of the same literature or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer according to the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution used for the invention, known in-line mixer and in-plant mixer can be used favorably. Preferred in-line mixer used for the invention is described in JP-A No. 2002-85948, and the in-plant mixer is described in JP-A No. 2002-90940.

The coating solution according to the invention is preferably subjected to antifoaming treatment to maintain the coated surface in a fine state. Preferred method for antifoaming treatment in the invention is described in JP-A No. 2002-66431.

In the case of applying the coating solution according to the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying air and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 sec to 60 sec. More preferably, heating is performed in a temperature range of from 70° C. to 90° C. at the film surface, and the time period for heating is from 2 sec to 10 sec. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which forms an image on the photothermographic material without using other sheets such as an image-receiving material).

13) Wrapping Material

In order to suppress fluctuation from occurring on photographic property during raw stock storage of the photothermographic material of the invention, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

(Image Forming Method)

1) Imagewise Exposure

The photothermographic material of the invention may be subjected to imagewise exposure by any known methods. Preferably, a laser beam is used as an exposure light source.

As the laser beam which can be used in the invention, He—Ne laser of red through infrared emission, red laser diode, or $Ar^+$, He—Ne, He—Cd laser of blue through green emission, or blue laser diode are described. Preferred is red to infrared laser diode, and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, even more preferably from 5 seconds to 25 seconds and, particularly preferably from 7 seconds to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, it is preferred to use the photothermographic materials of the present invention, which exhibit high sensitivity and are hardly influenced by environmental temperature, in combination with the process.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the present invention is preferably employed as photothermographic materials for use in medical diagnosis, photothermographic materials for use in industrial photographs, photothermographic materials for use in graphic arts, as well as for COM, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

Formula (1) (for Undercoat Layer on the Image Forming Layer Side)

| | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenyl ether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |

Formula (2) (for First Layer on the Backside)

| | |
|---|---|
| Styrene-butadiene copolymer latex (solid content of 40% by weight, styrene/butadiene mass ratio = 68/32) | 130.8 g |
| Sodium salt of 2,4-dichloro-6-hydroxy-s-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |

Formula (3) (for Second Layer on the Backside)

| | |
|---|---|
| $SnO_2$/SbO (9/1 by mass ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

<Undercoating>

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 8.4 mL/$m^2$, and dried at 180° C. for 6 minutes. Thus, an undercoated support was produced.

(Preparation of Coating Solution for Back under Layer)

A vessel was kept at 45° C., and thereto were added 100 g of gelatin, 0.2 g of benzisothiazolinone, and 1900 mL of water to allow gelatin to be dissolved. Additionally, 1 mL of a 1 mol/L aqueous solution of sodium hydroxide was added and mixed well. Just prior to the coating, 160 mL of a 4% by weight aqueous solution of N,N-ethylenebis(vinylsulfone acetamide) was admixed.

(Preparation of Coating Solution for Antihalation Layer)

A vessel was kept at 40° C., and thereto were added 1000 g of gelatin, 4 g of benzisothiazolinone, and 9500 mL of water to allow gelatin to be dissolved. Additionally, 40 mL of a 1 mol/L aqueous solution of sodium hydroxide, 1100 mL of a 5% by weight aqueous solution of blue dye-2, and 1200 mL of a 25% by weight aqueous solution of dye fixing agent B-1 were added and mixed well. Just prior to the coating, 1000 mL of a 20% by weight liquid of ethyl acrylate/acrylic acid copolymer (mass ratio of the copolymerization of 96.4/3.6 was admixed to give a coating solution for the antihalation layer in an amount of 16000 mL. The pH of the resulting coating solution was 7.3. Viscosity of the coating solution was 17 [mPa·s] which was measured with a B type viscometer at 40° C. (No. 1 rotor, 60 rpm).

Blue dye-2

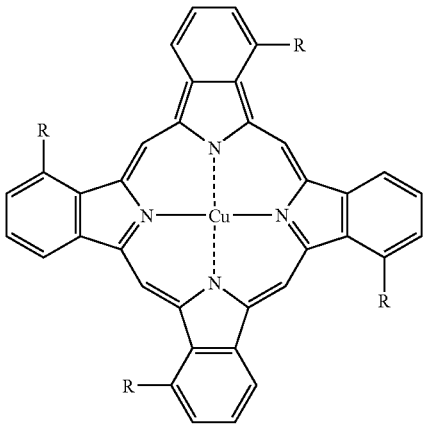

R = $SO_2CH_2CH_2CH_2SO_3Na$

-continued

Dye fixing agent B-1

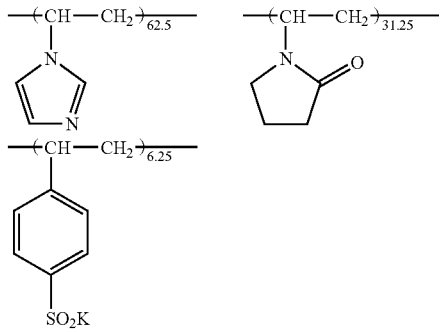

(Preparation of Coating Solution for Back Surface Protective Layer)

A vessel was kept at 40° C., and thereto were added 1000 g of gelatin having an isoelectric point of 4.8 (PZ gelatin, manufactured by Miyagi Chemical Industry Co., Ltd.), 6 g of benzisothiazolinone, and water to allow gelatin to be dissolved. Additionally, a 1 mol/L aqueous solution of sodium hydroxide was added as a pH controlling agent, and 170 g of gelatin dispersion of fine particles of monodispersed poly (ethylene glycol dimethacrylate-co-methyl methacrylate) (mean particle size of 7.7 μm, standard deviation of particle diameter of 0.3, 20% by weight), 360 g of a 10% by weight gelatin emulsified dispersion of liquid paraffin, 10 g of a 10% by weight emulsified dispersion of dipentaerythritol hexaisostearate, 240 mL of a 5% by weight aqueous solution of sodium di(2-ethylhexyl)sulfosuccinate, 400 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 720 mL of a 20% by weight liquid of ethyl acrylate/acrylic acid copolymer (mass ratio of the copolymerization of 96.4/3.6) latex were admixed. Just prior to the coating, 1200 mL of a 4% by weight aqueous solution of 2,4-dichloro-6-hydroxy-s-triazine was admixed to give a coating solution for the back surface protective layer in an amount of 18600 mL. The pH of the resulting coating solution was 7.2. Viscosity of the coating solution was 20 [mPa·s] which was measured with a B type viscometer at 40° C. (No. 1 rotor, 60 rpm).

4) Coating of Back Layer

The backside of the undercoated support described above was subjected to simultaneous multilayer coating so that the coating solution for the back under layer gave the coating amount of gelatin of 0.49 g/$m^2$, so that the coating solution for the antihalation layer gave the coating amount of gelatin of 1.05 g/$m^2$, and so that the coating solution for the back surface protective layer gave the coating amount of gelatin of 1.19 g/$m^2$, followed by drying to produce a back layer.

(Image Forming Layer, Intermediate Layer, and Surface Protective Layer)

1. Preparations of Coating Material

1) Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless-steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: the addition of the methanol solution of the spectral sensitizing dye A and the spectral sensitizing dye B was changed to a solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b, and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resulting reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resulting reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparations of Development Accelerator-2 Dispersion and Color-Tone-Adjusting Agent-1 Dispersion Also concerning solid dispersions of development accelerator-2 and color-tone-adjusting agent-1, dispersion was executed similar to that in the development accelerator-1, and thereby dispersions of 20% by weight and 15% by weight were respectively obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate, and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203), and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

<<Preparation of Solid Dispersion A of Azomethine Dye>>

To 1.0 kg of azomethine dye-A and 3.0 kg of a 10% by weight aqueous solution of modified poly(vinyl alcohol) (manufactured by Kuraray Co., Ltd., Poval MP-203) were added 42 g of a 48% by weight aqueous solution of surfactant "PIONIN A-43-S" (trade name, available from Takemoto Oil & Fat Co., Ltd.) and 3.0 g of an antifoaming agent (trade name: SURFYNOL 104E, manufactured by Nissin Chemical Industry Co., Ltd.), and the mixture was thoroughly mixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 1.0 g of a benzisothiazolinone sodium salt and water were added thereto, thereby adjusting the concentration of the water-insoluble azomethine dye to be 10% by weight. This dispersion was warmed at 40° C. for 2 hours to obtain solid dispersion A of azomethine dye. Particles of the azomethine dye included in the resulting azomethine dye dispersion had a median diameter of 0.49 μm, and a maximum particle diameter of 2.6 μm or less. The resulting azomethine dye dispersion was subjected to filtration with a polypropylene filter having a pore size of 3.0 μm to remove foreign substances such as dust, and stored.

Azomethine dye-A

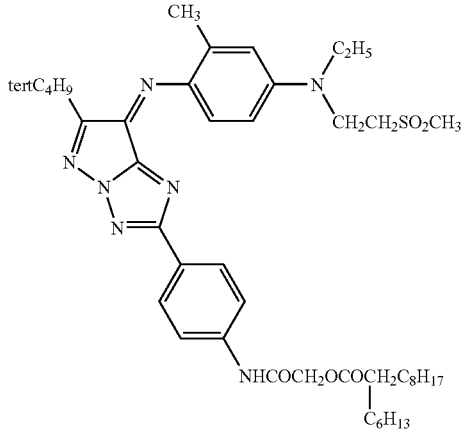

11) Preparation of SBR Latex Liquid

SBR latex (TP-1) was prepared as follows.

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid content of 44% by weight, an equilibrium moisture content at 25° C. and 60% RH of 0.6% by weight, and an ionic conductivity of 4.80 mS/cm (measurement of the ionic conductivity was performed using a conductometer CM-30S manufactured by To a Electronics Ltd. for the latex stock solution (44% by weight) at 25° C.).

12) Preparation of Isoprene Latex Liquid

Isoprene latex (TP-2) was prepared as follows.

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless-steel vessel surface and stainless-steel stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, the resulting mixture was filtered with a polypropylene filter having a pore size of 1.0 μm to remove foreign substances such as dust, and stored. 1248 g of isoprene latex TP-2 was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content at 25° C. and 60RH % of 0.4% by weight, and an ionic conductivity of 5.23 mS/cm (measurement of the ionic conductivity was performed using a conductometer CM-30S manufactured by Toa Electronics Ltd. at 25° C.).

13) Preparation of Dispersion A of Silver Salt of Benzotriazole 1 kg of benzotriazole was added to a liquid prepared by dissolving 360 g of sodium hydroxide in 9100 mL of water, and then the mixture was stirred for 60 minutes. Thereby, solution BT of sodium salt of benzotriazole was prepared.

A liquid prepared by dissolving 55.9 g of alkali-processed de-ionized gelatin in 1400 mL of distilled water was kept at 70° C. while stirring in a stainless-steel reaction vessel. And then, solution A prepared through diluting 54.0 g of silver nitrate by adding distilled water to give the volume of 400 mL, and solution B prepared through diluting 397 mL of the solution BT of sodium salt of benzotriazole with distilled water to give the volume of 420 mL were added. A method of double jet was executed through adding 220 mL of the solution B at a constant flow rate of 20 mL/min over 11 minutes to the stainless-steel reaction vessel, and at one minute post initiation of the addition of the solution B, 200 mL of the solution A was added thereto at a constant flow rate of 20 mL/min over 10 minutes. Moreover, at 6 minutes later after completing the addition, the solution A and the solution B were added simultaneously at a constant flow rate of 33.34 mL/min over 6 minutes in an amount of 200 mL respectively. The mixture was cooled to 45° C., and 92 mL of Demol N (10% by weight aqueous solution, manufactured by Kao Corporation) was added to the mixture while stirring. The mixture was adjusted to the pH of 4.1 with 1 mol/L sulfuric acid. After stopping stirring, the mixture was subjected to precipitation/desalting/water washing steps.

Thereafter, the resulting mixture was warmed to 50° C. and 51 mL of 1 mol/L sodium hydroxide was added thereto while stirring, and then 11 mL of a 3.5% by weight methanol solution of benzisothiazolinone and 7.7 mL of a 1% by weight methanol solution of sodium benzenethiosulfonate were added thereto. After stirring the mixture for a period of 80 minutes, the mixture was adjusted to the pH of 7.8 with 1 mol/L sulfuric acid. Thereby, dispersion A of silver salt of benzotriazole was prepared.

Particles of the prepared dispersion of silver salt of benzotriazole had a mean equivalent circular diameter of 0.172 μm (a variation coefficient of an equivalent circular diameter distribution of 18.5%), a mean length of long sides of 0.32 μm, a mean length of short sides of 0.09 μm, and a ratio of the mean length of long sides to the mean length of short sides of 0.298. Particle size and the like were determined from the average of 300 particles using an electron microscope.

2. Preparations of Coating Solution

1) Preparation of Coating Solution for Image Forming Layer

To the dispersion of the silver salt of a fatty acid obtained as described above in an amount of 1000 g were serially added 135 mL of water, 24 mL of the blue dye-2 aqueous solution, 5 g of the solid dispersion A of azomethine dye, 25 g of the organic polyhalogen compound-1 dispersion, 39 g of the organic polyhalogen compound-2 dispersion, 171 g of the phthalazine compound-1 solution, 318 g of the SBR latex liquid (TP-1), 742 g of the isoprene latex liquid (TP-2), 153 g of the reducing agent-2 dispersion, 22 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution. By adding, just prior to the coating, 140 g of the mixed emulsion A for a coating solution thereto and mixing sufficiently, a coating solution for the image forming layer was prepared, and allowed to be transported to a coating die and coated.

Viscosity of the above-described coating solution for the image forming layer was 35 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 38, 49, 48, 34, and 25 [mPa·s], respectively, at the shearing rate of 0.1, 1, 10, 100, 1000 [1/second].

The amount of zirconium in the coating solution was 0.30 mg per 1 g of silver.

2) Preparation of Coating Solution for Intermediate Layer

To 625 g of poly(vinyl alcohol) PVA-205 (manufactured by Kuraray Co., Ltd.), 163 g of the pigment-1 dispersion, 33 g of a 18.5% by weight aqueous solution of a blue dye-1 (manufactured by Nippon Kayaku Co., Ltd.: Kayafect turquoise RN liquid 150), 27 mL of a 5% by weight aqueous solution of sodium di(2-ethylhexyl)sulfosuccinate, 6205 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), and 135 mL of a 20% by weight aqueous solution of diammonium phthalate was added water to give total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

Viscosity of the coating solution was 25 [mPa·s] which was measured with a B type viscometer at 40° C. (No. 1 rotor, 60 rpm).

3) Preparation of Coating Solution for First Layer of Surface Protective Layers

In 704 mL of water were dissolved 100 g of inert gelatin and 10 mg of benzisothiazolinone, and thereto were added 146 g of the dispersion A of silver salt of benzotriazole, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 35 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 785 mL of water were dissolved 100 g of inert gelatin and 10 mg of benzisothiazolinone, and thereto were added 10 g of a 10% by weight emulsified dispersion of liquid paraffin, 30 g of a 10% by weight emulsified dispersion of dipentaerythritol hexaisostearate, 107 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 11 mL of a 1% by weight solution of a fluorocarbon surfactant (F-1), 11 mL of a 1% by weight aqueous solution of another fluorocarbon surfactant (F-2), 28 mL of a 5% by weight aqueous solution of sodium di(2-ethylhexyl)sulfosuccinate, 0.42 g of poly(methyl methacrylate) fine particles (mean particle diameter of 5.0 μm, distribution of volume weighted average being 25%), and 37 g of a 30% by weight solution of carnauba wax (Selosol 524, trade name, manufactured by Chukyou Yushi Co., Ltd.), and the obtained mixture was mixed to give a coating solution for the second layer of the surface protective layers, which was fed to a coating die to provide 4.2 mL/m$^2$.

Viscosity of the coating solution was 19 [mPa·s] which was measured with a B type viscometer at 40° C. (No. 1 rotor, 60 rpm).

3. Preparations of Photothermographic Material

1) Preparation of Photothermographic Material-1

Reverse surface to the back layer of the support coated with the back layer was subjected to simultaneous multilayer coating by a slide bead coating method in order of the image forming layer, intermediate layer, first layer of the surface protective layers, and second layer of the surface protective layers, starting from the undercoated face, and thereby sample of photothermographic material was produced.

The second layer of the surface protective layers forms the outermost layer on the image forming layer side. In the process, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m$^2$) for the image forming layer is as follows.

| | |
|---|---|
| Silver salt of a fatty acid | 5.95 |
| Blue dye-2 | 0.28 |
| Azomethine dye-A | 0.10 |
| Organic polyhalogen compound-1 | 0.16 |
| Organic polyhalogen compound-2 | 0.32 |
| Phthalazine compound-1 | 0.20 |
| SBR latex (TP-1) | 3.20 |
| Isoprene latex (TP-2) | 7.46 |
| Reducing agent-2 | 0.87 |
| Hydrogen bonding compound-1 | 0.127 |
| Development accelerator-1 | 0.021 |
| Development accelerator-2 | 0.018 |
| Color-tone-adjusting agent-1 | 0.007 |
| Mercapto compound-2 | 0.003 |
| Silver halide (on the basis of Ag content) | 0.15 |

Conditions for coating and drying were as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the backside as a Beck's smoothness. In addition, measurement of the film surface pH on the image forming layer side gave the result of 6.0.

2) Preparations of Photothermographic Material-2 to -25

Preparations of photothermographic material-2 to -25 were conducted in a similar manner to the process in the preparation of photothermographic material-1, except that: the fluorocarbon surfactant (F-1), the fluorocarbon surfactant (F-2), and the acrylic latex contained in the second layer of the surface protective layers, which is the outermost layer, were removed; the polymer latex containing a fluorine atom shown in Table 1 was added instead of these; and the addition amount of the poly(methyl methacrylate) fine particles as the matting agent and the addition amount of gelatin were each adjusted to give the coating amount shown in Table 1.

TABLE 1

| Sample No. | Latex No. | Latex Addition Amount (g/m$^2$) | Coating Amount of Gelatin in Outermost Layer | Matting Agent Mean Particle Diameter (Distribution) | Matting Agent Addition Amount (g/m$^2$) | Number of convex portion (per 1 mm$^2$) | $F_{1s}/C_{1s}$ Value | Abrasion Resistance | Adhesion Resistance | Note |
|---|---|---|---|---|---|---|---|---|---|---|
| 1 | Acrylic latex A* | 0.05 | 0.4 | 5.0 μm (mono-dispersion) | 0.0014 | 20 | 0.0 | Δ | x | Comparative |
| 2 | Acrylic latex A* | 0.05 | 0.4 | 5.0 μm (mono-dispersion) | 0.026 | 380 | 0.0 | Δ | x | Comparative |
| 3 | Acrylic latex A* | 0.05 | 0.4 | 5.0 μm (mono-dispersion) | 0.104 | 1520 | 0.0 | x | Δ | Comparative |
| 4 | FS-6010 manufactured by Fluoro Technology Co., Ltd. | 0.05 | 0.4 | 5.0 μm (mono-dispersion) | 0.00035 | 5 | 4.8 | ○ | x | Comparative |
| 5 | FS-6010 manufactured by Fluoro Technology Co., Ltd. | 0.05 | 0.4 | 5.0 μm (mono-dispersion) | 0.0014 | 20 | 4.7 | ○ | Δ | Invention |
| 6 | FS-6010 manufactured by Fluoro Technology Co., Ltd. | 0.05 | 0.4 | 5.0 μm (mono-dispersion) | 0.0065 | 95 | 4.8 | ○ | ○ | Invention |
| 7 | FS-6010 manufactured by Fluoro Technology Co., Ltd. | 0.05 | 0.4 | 5.0 μm (mono-dispersion) | 0.026 | 380 | 4.9 | ○ | ○ | Invention |
| 8 | FS-6010 manufactured by Fluoro Technology Co., Ltd. | 0.05 | 0.4 | 5.0 μm (mono-dispersion) | 0.104 | 1520 | 4.8 | Δ | ○ | Invention |
| 9 | AG-7000 manufactured by Asahi Glass Co., Ltd | 0.05 | 0.4 | 5.0 μm (mono-dispersion) | 0.00035 | 5 | 5.1 | ○ | x | Comparative |
| 10 | AG-7000 manufactured by Asahi Glass Co., Ltd. | 0.05 | 0.4 | 5.0 μm (mono-dispersion) | 0.0014 | 20 | 52.0 | ○ | Δ | Invention |
| 11 | AG-7000 manufactured by Asahi Glass Co., Ltd. | 0.05 | 0.4 | 5.0 μm (mono-dispersion) | 0.0065 | 95 | 5.0 | ○ | ○ | Invention |
| 12 | AG-7000 manufactured by Asahi Glass Co., Ltd. | 0.05 | 0.4 | 5.0 μm (mono-dispersion) | 0.026 | 380 | 4.9 | ○ | ○ | Invention |
| 13 | AG-7000 manufactured by Asahi Glass Co., Ltd. | 0.05 | 0.4 | 5.0 μm (mono-dispersion) | 0.104 | 1520 | 5.1 | Δ | ○ | Invention |
| 14 | NDN-2000 manufactured by Nicca Chemical Co., Ltd. | 0.05 | 0.4 | 5.0 μm (mono-dispersion) | 0.00035 | 5 | 5.4 | ○ | x | Comparative |

TABLE 1-continued

| Sample No. | Latex No. | Latex Addition Amount ($g/m^2$) | Coating Amount of Gelatin in Outermost Layer | Matting Agent Mean Particle Diameter (Distribution) | Matting Agent Addition Amount ($g/m^2$) | Number of convex portion (per 1 $mm^2$) | $F_{1s}/C_{1s}$ Value | Abrasion Resistance | Adhesion Resistance | Note |
|---|---|---|---|---|---|---|---|---|---|---|
| 15 | NDN-2000 manufactured by Nicca Chemical Co., Ltd. | 0.05 | 0.4 | 5.0 μm (mono-dispersion) | 0.0014 | 20 | 5.3 | ○ | Δ | Invention |
| 16 | NDN-2000 manufactured by Nicca Chemical Co., Ltd. | 0.05 | 0.4 | 5.0 μm (mono-dispersion) | 0.0065 | 95 | 5.5 | ○ | ○ | Invention |
| 17 | NDN-2000 manufactured by Nicca Chemical Co., Ltd. | 0.05 | 0.4 | 5.0 μm (mono-dispersion) | 0.026 | 380 | 5.6 | ○ | ○ | Invention |
| 18 | NDN-2000 manufactured by Nicca Chemical Co., Ltd. | 0.05 | 0.4 | 5.0 μm (mono-dispersion) | 0.104 | 1520 | 5.5 | Δ | ○ | Invention |
| 19 | NDN-2000 manufactured by Nicca Chemical Co., Ltd. | 0.05 | 0.4 | 4.3 μm (poly-dispersion) | 0.052 | 600 | 5.4 | ○ | ○ | Invention |
| 20 | NDN-2000 manufactured by Nicca Chemical Co., Ltd. | 0.05 | 0.4 | 4.3 μm (poly-dispersion) | 0.174 | 2000 | 5.5 | Δ | ○ | Invention |
| 21 | NDN-2000 manufactured by Nicca Chemical Co., Ltd. | 0.05 | 0.4 | 4.3 μm (poly-dispersion) | 0.436 | 5000 | 5.4 | x | ○ | Comparative |
| 22 | Fluorocarbon surfactant (F-1) | 0.05 | 0.4 | 4.3 μm (poly-dispersion) | 0.052 | 600 | 1.9 | Δ | x | Comparative |
| 23 | Fluorocarbon surfactant (F-1) | 0.05 | 0.4 | 4.3 μm (poly-dispersion) | 0.174 | 2000 | 1.8 | x | Δ | Comparative |
| 24 | Fluorocarbon surfactant (F-1) | 0.05 | 0.4 | 4.3 μm (poly-dispersion) | 0.436 | 5000 | 1.7 | x | ○ | Comparative |
| 25 | — | — | 0.4 | 4.3 μm (poly-dispersion) | 0.052 | 2000 | 0.0 | x | Δ | Comparative |

*Acrylic latex A: Methyl methacrylate/styrene/butyl acrylate/hydroxyethyl methacrylate/acrylic acid copolymer (mass ratio of the copolymerization of 57/8/28/5/2) latex Chemical structures of the compounds used in Examples of the invention are shown below.

Spectral sensitizing dye A

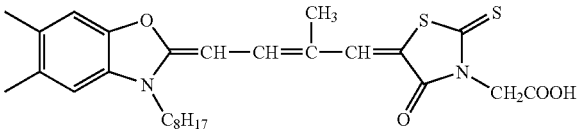

Spectral sensitizing dye B

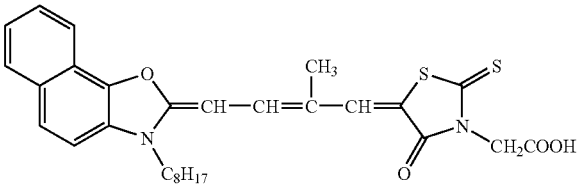

Tellurium sensitizer C

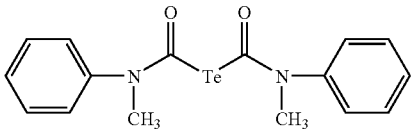

-continued

Compound 1 that is one-electron-oxidized to provide a one-electron oxidation product which releases one or more electrons

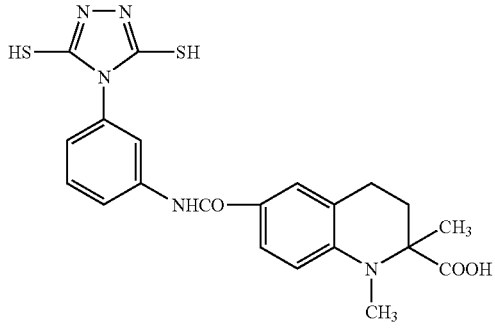

Compound 2 that is one-electron-oxidized to provide a one-electron oxidation product which releases one or more electrons

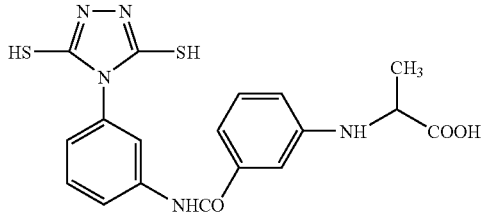

-continued

Compound 3 that is one-electron-oxidized to provide a one-electron oxidation product which releases one or more electrons

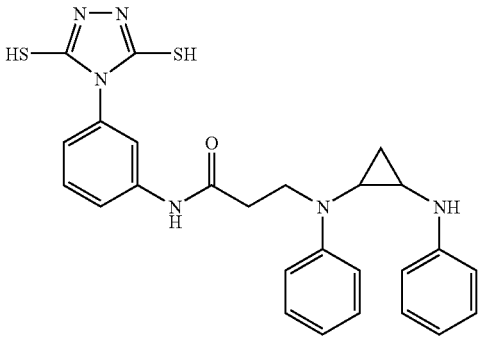

Compound 1 having adsorptive group and reducing group

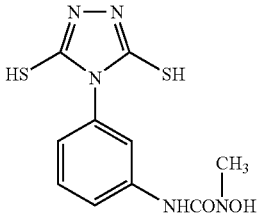

Compound 2 having adsorptive group and reducing group

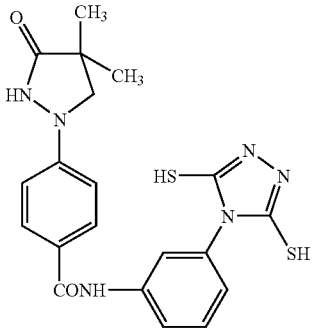

Reducing agent-1

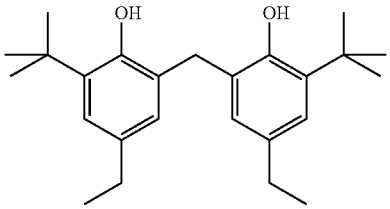

Reducing agent-2

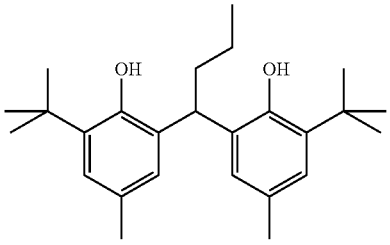

-continued

Hydrogen bonding compound-1

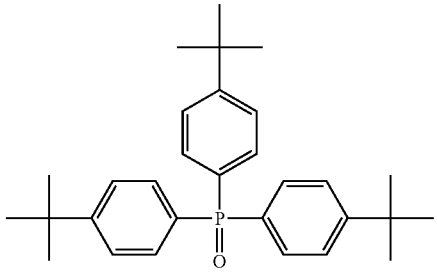

Organic polyhalogen compound-1

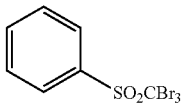

Organic polyhalogen compound-2

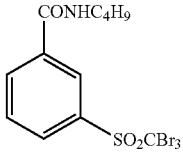

Mercapto compound-1

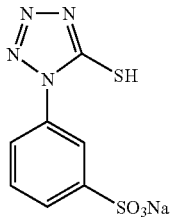

Mercapto compound-2

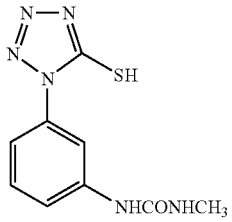

Phthalazine compound-1

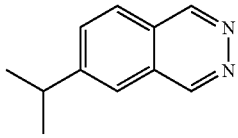

Development accelerator-1

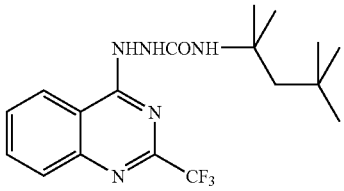

-continued

Development accelerator-2

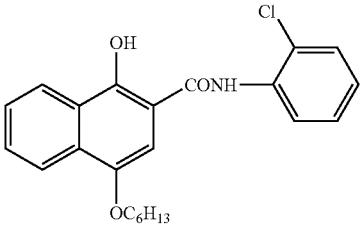

Color-tone-adjusting agent-1

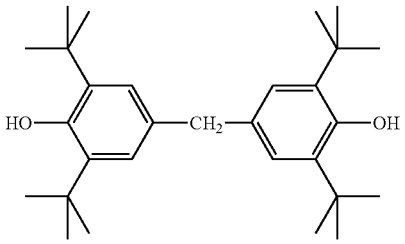

(F-1)

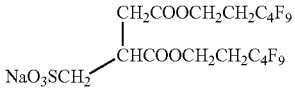

(F-2)

Mixture of

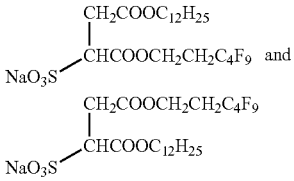

4. Evaluation on Photographic Performance

1) Preparation

The obtained sample was cut into a half-cut size (43 cm in length×35 cm in width), and was wrapped with the following packaging material under an environment of 25° C. and 50% RH, and stored for 2 weeks at an ambient temperature. Thereafter, the evaluation described below was performed.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Imagewise Exposure and Thermal Development

To each sample, imagewise exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation of the obtained image was performed with a densitometer.

3) Performance Evaluation (Evaluation Terms)

<Measurement of Number of Convex Portions Having a Height of 1.5 μm or Higher by Matting Agent>

Convex portions having a height of 0.05 μm or higher were measured over 1 $mm^2$ in area of each sample by using SURFCOM 30B (trade name, produced by Tokyo Seimitsu Co., Ltd.), and then the number of convex portions having a height of 1.5 μm or higher were counted.

<Measurement of $F_{1S}/C_{1S}$>

The samples were cut into a size of 0.5 cm×0.5 cm, and then, the F/C value was determined by an elemental analysis with regard to fluorine atoms and carbon atoms using an ESCA 750 (trade name, produced by Shimadzu Corp.). The ratio can be calculated from the peak height by $F_{1S}$ for fluorine atoms and the peak height by $C_{1S}$ derived from CH for carbon atoms.

<Method of Evaluating Abrasion>

Concerning each sample, the surface of the image forming layer side and the surface opposite of the support from this side, namely the backside, were rubbed together three times while loaded with a weight of 100 g per 100 $cm^2$ of the photothermographic material.

To each sample, uniform exposure for giving a density of 2.0 and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. The obtained images were visually evaluated according to the following criteria.

○: No abrasions are seen.

Δ: Slight abrasions are seen but negligible.

x: Remarkable abrasions are seen.

<Evaluation on Adhesion Resistance>

Samples were left under an environment of 25° C. and 80% RH for 24 hours. Thereafter, concerning each sample, the surface of the image forming layer side and the surface of the backside were contacted and wrapped in a white glassine-made bag and sealed. The prepared bag was pressed with a load of 100 g per 12 $cm^2$ and kept in an incubator at 50° C. for a period of 7 days while loaded. Thereafter, sample was taken out from the bag and visual evaluation on the surface state was performed with regard to the adhered area.

○: No adhered portions are seen.

Δ: Slightly adhered portions are seen (the area where adhesion is seen is less than 10% of the total surface area).

x: 10% or more of the surface area is adhered thereto.

(Evaluation Result)

The obtained results are shown in Table 1.

It is clear from the result that the samples of the present invention exhibit excellent abrasion resistance and excellent adhesion resistance.

Example 2

Preparations of photothermographic material-26 to -35 were conducted in a similar manner to the process in the preparation of sample No. 17 of Example 1, except that the polymer latex containing a fluorine atom which was incorporated in the second layer of the surface protective layers (outermost layer) was changed to the compound shown in Table 2, and the addition amount thereof were adjusted as shown in Table 2.

The obtained samples were evaluated similar to Example 1, and the obtained results are shown in Table 2.

As a result, the samples of the invention exhibit excellent results, similar to Example 1. In particular, in the case where the polymer latex containing a fluorine atom is used so as to provide the $F_{1S}/C_{1S}$ ratio of 2.0 or more for the surface on the image forming layer side, the sample gives favorable results with excellent adhesion resistance.

TABLE 2

| Sample No. | Latex No. | Latex Addition Amount ($g/m^2$) | Coating Amount of Gelatin in Outermost Layer | Matting Agent Mean Particle Diameter (Distribution) | Matting Agent Addition Amount ($g/m^2$) | Number of convex portion (per 1 $mm^2$) | $F_{1s}/C_{1s}$ Value | Abrasion Resistance | Adhesion Resistance | Note |
|---|---|---|---|---|---|---|---|---|---|---|
| 26 | NDN-2000 manufactured by Nicca Chemical Co., Ltd. | 0.005 | 0.4 | 5.0 μm (mono-dispersion) | 0.026 | 380 | 1.2 | ○ | Δ | Invention |
| 27 | NDN-2000 manufactured by Nicca Chemical Co., Ltd. | 0.010 | 0.4 | 5.0 μm (mono-dispersion) | 0.026 | 380 | 2.0 | ○ | ○ | Invention |
| 28 | NDN-2000 manufactured by Nicca Chemical Co., Ltd. | 0.050 | 0.4 | 5.0 μm (mono-dispersion) | 0.026 | 380 | 5.0 | ○ | ○ | Invention |
| 29 | NDN-2000 manufactured by Nicca Chemical Co., Ltd. | 0.100 | 0.4 | 5.0 μm (mono-dispersion) | 0.026 | 380 | 8.0 | ○ | ○ | Invention |
| 30 | NDN-2000 manufactured by Nicca Chemical Co., Ltd. | 0.200 | 0.4 | 5.0 μm (mono-dispersion) | 0.026 | 380 | 12.0 | ○ | ○ | Invention |
| 31 | AG-7000 manufactured by Asahi Glass Co., Ltd. | 0.005 | 0.4 | 5.0 μm (mono-dispersion) | 0.026 | 380 | 1.0 | ○ | Δ | Invention |
| 32 | AG-7000 manufactured by Asahi Glass Co., Ltd. | 0.010 | 0.4 | 5.0 μm (mono-dispersion) | 0.026 | 380 | 1.8 | ○ | ○ | Invention |
| 33 | AG-7000 manufactured by Asahi Glass Co., Ltd. | 0.050 | 0.4 | 5.0 μm (mono-dispersion) | 0.026 | 380 | 5.0 | ○ | ○ | Invention |
| 34 | AG-7000 manufactured by Asahi Glass Co., Ltd. | 0.100 | 0.4 | 5.0 μm (mono-dispersion) | 0.026 | 380 | 7.5 | ○ | ○ | Invention |
| 35 | AG-7000 manufactured by Asahi Glass Co., Ltd. | 0.200 | 0.4 | 5.0 μm (mono-dispersion) | 0.026 | 380 | 11.0 | ○ | ○ | Invention |

What is claimed is:

1. A photothermographic material comprising, on one side of a support, an image forming layer comprising at least a photosensitive silver halide, a non-photosensitive organic silver salt, a reducing agent, and a binder, and at least one non-photosensitive layer which is an outermost layer disposed on the same side of the support as the image forming layer and farther from the support than the image forming layer, wherein the non-photosensitive layer comprises at least a copolymer latex of an acrylate or methacrylate having a fluorine atom and a monomer component having a hydrophobic group, gelatin as a binder at a content of 0.3 $g/m^2$ to 5.0 $g/m^2$ and a matting agent having a mean particle size of from 2.0 μm to 8.0 μm at a content of 0.0001 $g/m^2$ to 0.08 $g/m^2$, and the surface of the side having the image forming layer comprises convex portions having a height of 1.5 μm or higher in an amount of from 20 to 2000 per 1 $mm^2$.

2. The photothermographic material according to claim 1, wherein the acrylate or methacrylate having a fluorine atom is represented by the following formula (1):

Formula (1)

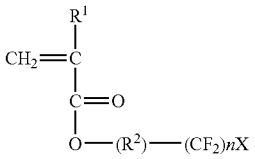

wherein $R^1$ represents a hydrogen atom, a fluorine atom, or a methyl group; $R^2$ represents a methylene group, an ethylene group, or a 2-hydroxypropylene group; X represents a hydrogen atom or a fluorine atom; and n represents an integer of from 1 to 4.

3. The photothermographic material according to claim 1, wherein the monomer component having a hydrophobic group is represented by the following formula (2):

Formula (2)

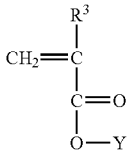

wherein $R^3$ represents a hydrogen atom or a methyl group; and Y represents an alkyl group, an alicyclic group, or an aromatic ring group.

4. The photothermographic material according to claim 1, wherein an $F_{1S}/C_{1S}$ ratio of the surface on the side having the image forming layer is 2.0 or more.

5. The photothermographic material according to claim 1, wherein the photothermographic material further comprises a non-photosensitive layer containing an organic silver salt, which is different from the non-photosensitive organic silver salt contained in the image forming layer, on the same side of the support as the image forming layer and farther from the support than the image forming layer.

6. The photothermographic material according to claim 5, wherein the photothermographic material comprises the non-photosensitive layer containing an organic silver salt between the image forming layer and the non-photosensitive layer containing the copolymer latex of an acrylate or methacrylate having a fluorine atom and a monomer component having a hydrophobic group.

7. The photothermographic material according to claim 1, wherein the image forming layer further comprises a polymer latex having a monomer component represented by the following formula (M):

$$CH_2{=}CR^{01}{-}CR^{02}{=}CH_2 \qquad \text{Formula (M)}$$

wherein $R^{01}$ and $R^{02}$ each independently represent a hydrogen atom, an alkyl group having 1 to 6 carbon atoms, a halogen atom, or a cyano group.

8. The photothermographic material according to claim 7, wherein, in formula (M), both of $R^{01}$ and $R^{02}$ are a hydrogen atom, or one of $R^{01}$ or $R^{02}$ is a hydrogen atom and the other is a methyl group.

9. The photothermographic material according to claim 1, wherein the photothermographic material comprises a dye represented by the following formula (PC-1):

Formula (PC-1)

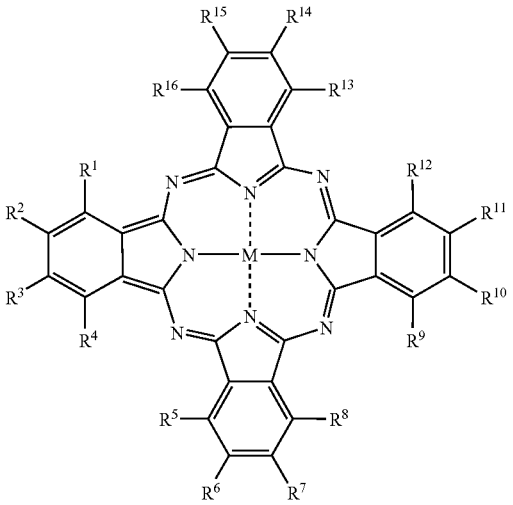

wherein M represents a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electron-attracting group; and $R^2$, $R^3$, $R^6$, $R^7$, $R^{10}$, $R^{11}$, $R^{14}$, and $R^{15}$ each independently represent a hydrogen atom or a substituent.

10. The photothermographic material according to claim 9, wherein, in formula (PC-1), at least one of $R^1$, $R^4$, $R^5$, $R^8$, $R^9$, $R^{12}$, $R^{13}$, and $R^{16}$ is a group represented by formula (II):

$-L^1-R^{17}$ Formula (II)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*; ** denotes a bond with a phthalocyanine skeleton at this position; * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents a hydrogen atom, an alkyl group, an aryl group, or a heterocyclic group.

11. The photothermographic material according to claim 10, wherein, in formula (PC-1), four or more from among $R^1$, $R^4$, $R^5$, $R^8$, $R^9$, $R^{12}$, $R^{13}$, and $R^{16}$ are each independently a group represented by formula (II).

12. The photothermographic material according to claim 10, wherein, in formula (PC-1), $R^2$, $R^3$, $R^6$, $R^7$, $R^{10}$, $R^{11}$, $R^{14}$, and $R^{15}$ are each a hydrogen atom, and at least one of $R^1$, $R^4$, $R^5$, $R^8$, $R^9$, $R^{12}$, $R^{13}$, and $R^{16}$ is a group represented by formula (II).

13. The photothermographic material according to claim 12, wherein, in formula (PC-1), four or more from among $R^1$, $R^4$, $R^5$, $R^8$, $R^9$, $R^{12}$, $R^{13}$, and $R^{16}$ are each independently a group represented by formula (II).

14. The photothermographic material according to claim 9, wherein the dye represented by formula (PC-1) is a water-soluble dye.

15. The photothermographic material according to claim 9, wherein the dye represented by formula (PC-1) is contained in at least one layer on the side of the support having the image forming layer.

16. The photothermographic material according to claim 9, wherein the dye represented by formula (PC-1) is contained in at least one layer on the backside of the support.

17. The photothermographic material according to claim 1, wherein the non-photosensitive layer is coated by an aqueous coating solution for the non-photosensitive layer.

* * * * *